US006893811B2

(12) United States Patent
Kikuchi et al.

(10) Patent No.: US 6,893,811 B2
(45) Date of Patent: May 17, 2005

(54) SILVER HALIDE PHOTOGRAPHIC EMULSION

(75) Inventors: Makoto Kikuchi, Minami-Ashigara (JP); Yoichi Hosoya, Minami-Ashigara (JP); Genichi Furusawa, Minami-Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 30 days.

(21) Appl. No.: 10/662,422

(22) Filed: Sep. 16, 2003

(65) Prior Publication Data

US 2004/0067459 A1 Apr. 8, 2004

(30) Foreign Application Priority Data

Sep. 18, 2002 (JP) ..... 2002-271717

(51) Int. Cl.[7] ..... G03C 1/005; G03C 1/494
(52) U.S. Cl. ..... 430/567; 430/569; 430/502
(58) Field of Search ..... 430/567, 569, 430/502

(56) References Cited

U.S. PATENT DOCUMENTS 6,593,072 B1 * 7/2003 Royster, Jr. ..... 430/567
6,797,459 B2 * 9/2004 Shirata ..... 430/567
2001/0031434 A1 10/2001 Ihama

* cited by examiner

*Primary Examiner*—Geraldine Letscher
(74) *Attorney, Agent, or Firm*—Sughrue Mion, PLLC

(57) ABSTRACT

A silver halide photographic emulsion comprising epitaxial junction type tabular grains. The epitaxial junction type tabular grains each satisfying the following requirements (i) to (iv) occupy 100 to 50% (grain numerical ratio) of all the grains contained in the silver halide photographic emulsion:

(i) host tabular grain is a tabular grain of silver iodobromide or silver iodochlorobromide having {111} faces as main planes and two parallel twin planes;

(ii) at least one silver halide epitaxial portion is formed, per grain, only on a corner portion of the host tabular grain;

(iii) a portion of an external surface of the silver halide epitaxial portion has a face parallel to the main plane of the host tabular grain; and (iv) a portion of an external surface of the silver halide epitaxial portion has a {100} face.

7 Claims, 2 Drawing Sheets

SILVER HALIDE PHOTOGRAPHIC EMULSION

CROSS-REFERENCE TO RELATED APPLICATIONS

This application is based upon and claims the benefit of priority from the prior Japanese Patent Application No. 2002-271717, filed Sep. 18, 2002, the entire contents of which are incorporated herein by reference.

BACKGROUND OF THE INVENTION

1. Field of the Invention

The present invention relates to a silver halide emulsion having a high speed and enhanced gradation.

2. Description of the Related Art

With respect to silver halide photosensitive materials, silver halide tabular grains (hereinafter also referred to simply as "tabular grains") have a multiplicity of advantages, so that they are now widely used in the field thereof. In recent years, the progress of related technology is striking. In the field of this technology, it is a well-known fact that the tabular grains have a large specific surface area and accordingly can increase the amount of sensitizing dye, capable of contributing to light absorption, adsorbed on silver halide grains, so that speed enhancement can be attained thereby. In this field, "speed enhancement" of tabular grains is an important theme. Speed enhancement technologies have been extensively and intensively studied in this field. Recently, for example, a method of sensitizing by the use of epitaxial junction has been disclosed as a technology for enhancing the speed of tabular grains (e.g., Jpn. Pat. Appln. KOKAI Publication No. (hereinafter referred to as JP-A-) 2001-235821). However, even the technology described in the patent application specifications is not satisfactory from the viewpoint of "speed enhancement". Thus, there has been a strong demand for a new speed enhancement technology for tabular grains with a view toward developing a photosensitive material of further enhanced speed.

The present invention has realized such an enhanced speed as the prior art has failed to attain. In the prior technical literature including the above-mentioned patent publication, there is no description suggesting the subject matter of the present invention, namely, that a photographic performance of high speed and enhanced gradation can be achieved by an emulsion characterized by grains wherein a corner portion of each of the host tabular grains has epitaxial junction, wherein a region of an external surface of the epitaxial portion has a face parallel to the main plane of host grains and a region of the external surface of the epitaxial portion has a {100} face, and wherein the epitaxial portion has a dislocation line.

BRIEF SUMMARY OF THE INVENTION

The inventors have tackled the method of enhancing speed by epitaxial junction, in particular, with respect to tabular grains that are excellent in photographic performance, such as ratio of speed/graininess. As a result, it has become apparent that the speed enhancement attained by the above-mentioned prior art is unsatisfactory and that with respect to gradation as well, an enhancement to high gradation is needed.

Accordingly, it is an object of the present invention to provide a superior silver halide photographic emulsion exhibiting a high speed and an enhanced gradation and to provide a silver halide photosensitive material containing the emulsion.

The inventors have tackled establishing of a method of enhancing speed by tabular grains to each of which epitaxial junction is introduced and have found for the first time that a photographic emulsion realizing a high speed and an enhanced gradation can be obtained by forming an epitaxial portion having a face parallel to the main planes of host tabular grain and a {100} face at portions of the external surface thereof, only on a corner portion of the host tabular grain. Moreover, it has been found that a photographic emulsion realizing a higher speed and a further enhanced gradation can be obtained by introducing a dislocation line in the epitaxial portion.

That is, there are provided the following silver halide photographic emulsions and silver halide photosensitive materials containing the same.

(1) A silver halide photographic emulsion wherein epitaxial junction type tabular grains each satisfying the following requirements (i) to (iv) occupy 100 to 50% (grain numerical ratio) of all the grains contained in the silver halide photographic emulsion:

(i) host tabular grain is a tabular grain of silver iodobromide or silver iodochlorobromide having {111} faces as main planes and two parallel twin planes;

(ii) at least one silver halide epitaxial portion is formed, per grain, only on a corner portion of the host tabular grain;

(iii) a portion of an external surface of the silver halide epitaxial portion has a face parallel to the main plane of the host tabular grain; and (iv) another portion of the external surface of the silver halide epitaxial portion has a {100} face.

(2) A silver halide photographic emulsion wherein epitaxial junction type tabular grains each satisfying the above-mentioned requirements (i) to (iv) occupy 100 to 80% (grain numerical ratio) of all the grains contained in the silver halide photographic emulsion.

(3) A silver halide photographic emulsion wherein epitaxial junction type tabular grains each satisfying not only the above-mentioned requirements (i) to (iv) but also the following requirement (v) occupy 100 to 50% (grain numerical ratio) of all the grains contained in the silver halide photographic emulsion:

(v) three to six silver halide epitaxial portions are formed, per grain, only on corner portions of the host tabular grain.

(4) A silver halide photographic emulsion wherein the epitaxial junction type tabular grains each satisfying the above-mentioned requirements (i) to (v) occupy 100 to 80% (grain numerical ratio) of all the grains contained in the silver halide photographic emulsion.

(5) The silver halide photographic emulsion according to any one of the items (1) to (4) above wherein at least one of the silver halide epitaxial portions has, per grain, at least one dislocation line.

(6) The silver halide photographic emulsion according to any one of the items (1) to (5) above wherein at least one of the silver halide epitaxial portions has, per silver halide epitaxial portion, (A) an inner region of the epitaxial portion having a silver bromide content of less than 30 mol %, and (B) an outer region of the epitaxial portion having a silver bromide content of 30 mol % or more.

(7) A silver halide photosensitive material comprising a support and, superimposed thereon, at least one silver halide emulsion layer, wherein the at least one silver halide emulsion layer contains the silver halide photographic emulsion according to any one of the items (1) to (6) above.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
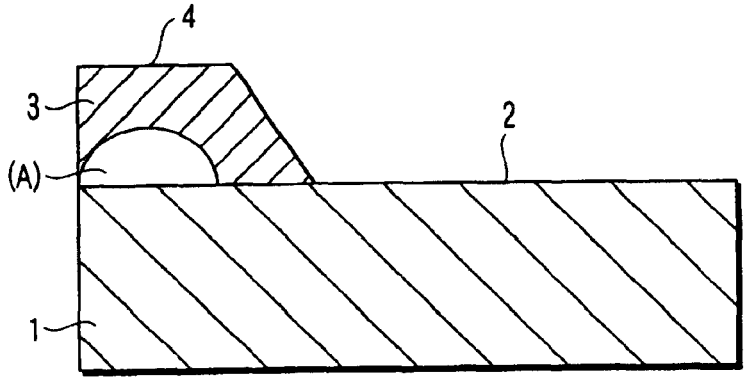
FIG. 1 is an example of a schematic view of a cross section, made perpendicularly to main planes of a host tabular grain, of the host tabular grain and an epitaxial portion formed on corner portion thereof.

In a preferred embodiment of the present invention, there is provided the following silver halide photographic emulsion. That is, the silver halide photographic emulsion is one wherein 100 to 50% (grain numerical ratio) of all the grains contained in the silver halide photographic emulsion are epitaxial junction type tabular grains of silver iodochlorobromide each having {111} faces as main planes and two parallel twin planes; there are, per grain, 1 to 6 silver halide epitaxial portions formed only on corner portion(s) of host tabular grains; portions of an external surface of the epitaxial portion have a face parallel to the main planes of the host tabular grains and a {100} face; each of the epitaxial portions has at least one dislocation line; and each of the epitaxial portions has (A) a region of less than 30 mol % silver bromide content and (B) a region of 30 mol % or more silver bromide content in the epitaxial portion.

First, the configuration of the silver halide grains of the present invention will be described.

The silver halide emulsion of the present invention comprises grains having tabular grains as host grains, and having, per grain, at least one silver halide epitaxial portion only on corner portion(s) of the tabular grains.

The host grains of the emulsion of the present invention are composed of tabular grains having two opposite parallel {111} main planes and two parallel twin planes. The twin plane refers to {111} faces on both sides of which the ions of all lattice points are in the relationship of reflected images. The host tabular grains, as viewed in the direction perpendicular to the main planes thereof, have triangular or hexagonal shapes, or circular shapes corresponding to rounding thereof. Each of the host tabular grains has external surfaces parallel to each other.

With respect to the host grains of the emulsion of the present invention, it is preferred that hexagonal tabular grains whose adjacent side ratio (maximum side length/minimum side length) is in the range of 1.5 to 1 occupy 100 to 50%, in terms of grain numerical ratio, of all the grains contained in the emulsion. Such hexagonal tabular grains more preferably occupy 100 to 70%, still more preferably 100 to 80%. In the emulsion of the present invention, it is more preferred that hexagonal tabular grains whose adjacent side ratio (maximum side length/minimum side length) is in the range of 1.2 to 1 occupy 100 to 50%, in terms of grain numerical ratio, of all the grains contained in the emulsion. Such hexagonal tabular grains more preferably occupy 100 to 70%, most preferably 100 to 80%. When the main planes of tabular grains have a rounded triangular or hexagonal shape, the lengths of main plane sides refer to the lengths of sides of an imaginary triangle or hexagon as formed by extending the sides. Mixing of non-hexagonal tabular grains is not preferable from the viewpoint of intergranular homogeneity.

The host grains of the emulsion of the present invention preferably have an average equivalent circle diameter of 0.3 to 7.0 $\mu$m, more preferably 1 to 5 $\mu$m, and still more preferably 1.5 to 4 $\mu$m. Falling outside this diameter range is not favorable from the viewpoint of difficulty in exerting the effects of the present invention.

The host grains of the emulsion of the present invention preferably have an average grain thickness of 0.03 to 0.3 $\mu$m, more preferably 0.04 to 0.2 $\mu$m, and still more preferably 0.05 to 0.15 $\mu$m. Falling outside this thickness range is not favorable from the viewpoint of difficulty in exerting the effects of the present invention.

In the measurement of the equivalent circle diameter of tabular grains, for example, a transmission electron micrograph according to the replica method is taken, from which the diameter of a circle with an area equal to the projected area of each individual grain is determined.

The grain thickness cannot be simply calculated from the length of the shadow of the replica because of epitaxial deposition. However, the calculation can be effected by measuring the length of the shadow of the replica before epitaxial deposition. Alternatively, even after epitaxial deposition, the grain thickness can be easily determined by slicing a sample coated with tabular grains and taking an electron micrograph of a section thereof.

The ratio of equivalent circle diameter to thickness of silver halide grains is referred to as the aspect ratio. That is, the aspect ratio is the quotient of equivalent circle diameter with respect to the projected area of each individual silver halide grain divided by the thickness of the grain.

The host tabular grains of the emulsion of the present invention preferably have an average aspect ratio of 2 to 200, more preferably 4 to 100, and still more preferably 8 to 50. Falling outside this aspect ratio range is not favorable from the viewpoint of difficulty in exerting the effects of the present invention.

With respect to the host tabular grains of the emulsion of the present invention, the twin plane spacing may be 0.012

μm or less as described in U.S. Pat. No. 5,219,720, and the {111} main plane distance/twin plane spacing may be 15 or more as described in JP-A-5-249585. These can be selected in conformity with the purpose.

The twin plane can be observed through a transmission electron microscope. Specifically, a sample in which tabular grains are arranged approximately in parallel to a support is prepared. The sample is cut with a diamond knife to thereby prepare an approximately 0.1 μm thick section. The twin planes of the tabular grains can be detected by observing the section through a transmission electron microscope. When electron beams pass through the twin planes, a phase shift occurs in the electron waves. Thus, the presence of twin plane can be recognized.

It is preferred that the emulsion of the present invention be composed of monodispersed grains. In the emulsion of the present invention, the variation coefficient of grain size (equivalent sphere diameter) distribution of all the grains contained in the silver halide photographic emulsion is preferably in the range of 35 to 3%, more preferably 25 to 3%, and still more preferably 20 to 3%. The terminology "variation coefficient of equivalent sphere diameter distribution" used herein means the product obtained by dividing the dispersion (standard deviation) of equivalent sphere diameters of individual tabular grains by the average equivalent sphere diameter and multiplying the resultant quotient by 100. That the variation coefficient of equivalent sphere diameter distribution of all the tabular grains present exceeds 35% is not favorable from the viewpoint of intergranular homogeneity. On the other hand, it is difficult to prepare an emulsion wherein the variation coefficient is below 3%.

The variation coefficient of equivalent circle diameter distribution of all the grains contained in the emulsion of the present invention is preferably in the range of 40 to 3%, more preferably 30 to 3%, and still more preferably 20 to 3%. The terminology "variation coefficient of equivalent circle diameter distribution" used herein means the product obtained by dividing the dispersion (standard deviation) of equivalent circle diameters of individual grains by the average equivalent circle diameter and multiplying the resultant quotient by 100. That the variation coefficient of equivalent circle diameter distribution of all the grains contained in the silver halide photographic emulsion exceeds 40% is not favorable from the viewpoint of intergranular homogeneity. On the other hand, it is difficult to prepare an emulsion wherein the variation coefficient is below 3%.

The variation coefficient of grain thickness distribution of all the tabular grains contained in the emulsion of the present invention is preferably in the range of 25 to 3%, more preferably 20 to 3%, and still more preferably 15 to 3%. The terminology "variation coefficient of grain thickness distribution" used herein means the product obtained by dividing the dispersion (standard deviation) of grain thickness of individual tabular grains by the average grain thickness and multiplying the resultant quotient by 100. That the variation coefficient of grain thickness distribution of all the tabular grains present exceeds 25% is not favorable from the viewpoint of intergranular homogeneity. On the other hand, it is difficult to prepare an emulsion wherein the variation coefficient is below 3%.

The variation coefficient of twin plane spacing distribution of all the tabular grains contained in the emulsion of the present invention is preferably in the range of 25 to 3%, more preferably 20 to 3%, and still more preferably 15 to 3%. The terminology "variation coefficient of twin plane spacing distribution" used herein means the product obtained by dividing the dispersion (standard deviation) of twin plane spacings of individual tabular grains by the average twin plane spacing and multiplying the resultant quotient by 100. That the variation coefficient of twin plane spacing distribution of all the tabular grains present exceeds 25% is not favorable from the viewpoint of intergranular homogeneity. On the other hand, it is difficult to prepare an emulsion wherein the variation coefficient is below 3%.

The composition and structure of emulsion grains according to the present invention will be described below.

The silver halide composition of silver halide epitaxial junction type tabular grains for use in the present invention consists of silver iodochlorobromide. Basically, the silver halide composition consists of a combination such that the host tabular grains are constituted of silver iodobromide or silver iodochlorobromide while the epitaxial portions are constituted of silver chlorobromide or silver iodochlorobromide. The silver chloride content of grains consisting of host tabular grains combined with epitaxial portions is preferably in the range of 0.5 to 10 mol %, more preferably 1 to 8 mol %. The silver iodide content of tabular grains is preferably in the range of 2 to 25 mol %, more preferably 5 to 20 mol %.

In the emulsion of the present invention, it is preferred that the intergranular silver chloride content distribution of grains consisting of host tabular grains combined with epitaxial portions be uniform. The variation coefficient of silver chloride content distribution is preferably 20% or below.

Further, in the emulsion of the present invention, it is preferred that the intergranular silver iodide content distribution of grains consisting of host tabular grains combined with epitaxial portions be uniform. The variation coefficient of silver iodide content distribution is preferably 20% or below.

The intergranular variation coefficients of silver chloride content and silver iodide content can be easily determined by the EPMA method (Electron-Probe Micro Analyzer method). In this method, a sample wherein emulsion grains are well dispersed so as to avoid contacting thereof to each other is prepared. The sample is irradiated with electron beams. An elemental analysis of extremely minute region can be performed by an analysis with X-rays brought about by electron beam excitation. The halogen composition of each individual grain can be determined by measuring the intensity of characteristic X-rays of silver and iodine radiated from the individual grain in accordance with this method. Whether or not a certain emulsion is one according to the present invention can be judged by ascertaining the halogen composition of at least 100 grains in accordance with the EPMA method. The terminology "variation coefficient of silver chloride content or silver iodide content distribution" used herein means the product obtained by dividing the standard deviation of each distribution with respect to at least 100 grains by the average content and multiplying the resultant quotient by 100.

Now, the epitaxial junction will be described.

In the emulsion of the present invention, 100 to 50% (grain numerical ratio) of all the grains contained in the silver halide photographic emulsion are occupied by grains wherein there is, per grain, at least one silver halide epitaxial portion formed only on corner portions of host tabular grains. Preferably, 100 to 80% (grain numerical ratio) of all the grains contained in the silver halide photographic emulsion are occupied by such grains.

In a preferred embodiment, in the emulsion of the present invention, 100 to 50% (grain numerical ratio) of all the grains contained in the emulsion are occupied by grains wherein there are, per grain, 3 to 6 silver halide epitaxial portions formed only on corner portions of each of the host tabular grains. More preferably, 100 to 80% (grain numerical ratio) of all the grains contained in the emulsion are occupied by such grains.

The corner portions refer to the inside region of a circle of radius (r) drawn round each vertex of a triangle or hexagon exhibited by tabular grains when viewed in the direction perpendicular to the main planes thereof. Herein, the radius (r) refers to a length equal to y% of the length from the center of gravity to the vertex with respect to tabular grains. The percentage (y) is in the range of 2 to 50%, preferably 5 to 30%. In the present invention, on each corner portion of host grains, epitaxial portion may be separately formed on the two main planes (see FIG. 1 to be described later), or may be formed so as to be present from one of the main planes, via the side face, to the other back main plane (see FIG. 2 to be described later). In these instances, the epitaxial portion present on the two sides is counted as one epitaxial portion. When the main planes of tabular grains have a rounded triangular or hexagonal shape, the vertexes refer to the apexes of sides of an imaginary triangle or hexagon as formed by extending the sides of main plane.

In the emulsion grains of the present invention, the composition of epitaxial portions is silver chlorobromide or silver iodochlorobromide. The average silver chloride content of epitaxial portions is preferably in the range of 20 to 70 mol %, more preferably 30 to 60 mol %. The average silver bromide content of epitaxial portions is preferably in the range of 30 to 80 mol %, more preferably 40 to 70 mol %. The average silver iodide content of epitaxial portions is preferably in the range of 0 to 20 mol %.

Figure 3:
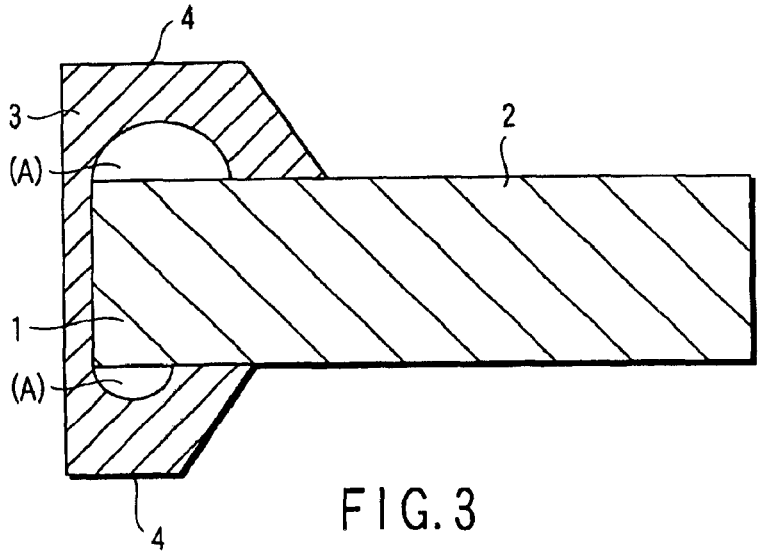
FIG. 3 is another example of another schematic view of a cross section, made perpendicularly to main planes of a host tabular grain, of the host tabular grain and an epitaxial portion formed on corner portion thereof.
Figure 4:
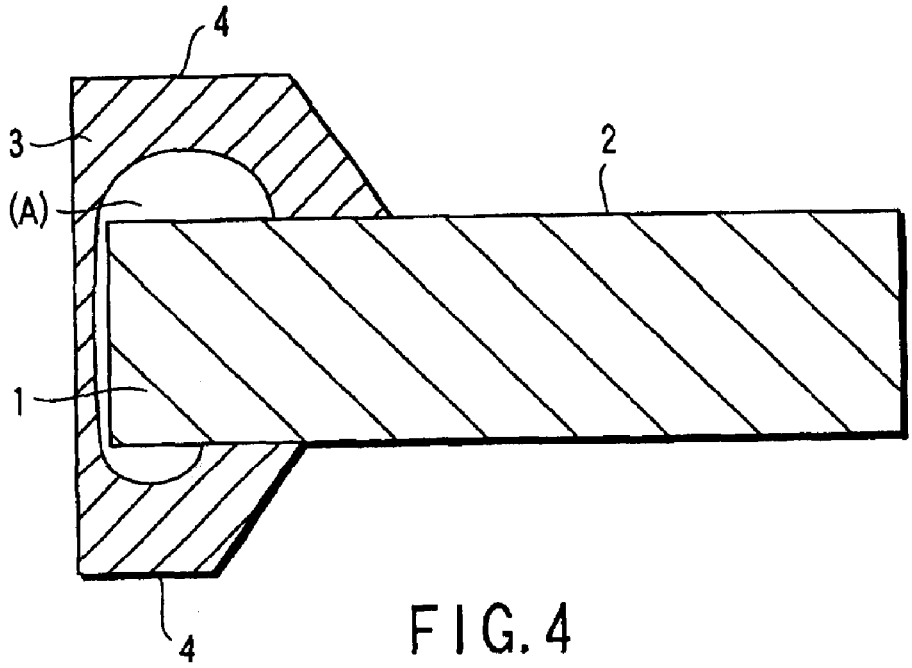
FIG. 4 is another example of another schematic view of a cross section, made perpendicularly to main planes of a host tabular grain, of the host tabular grain and an epitaxial portion formed on corner portion thereof.

In the emulsion of the present invention, it is preferred that grains wherein at least one of the silver halide epitaxial portions formed on only corner portions of host tabular grains consists of two regions each different in silver bromide content thereof, i.e., an inner region of epitaxial portion (A) having a lower silver bromide content and an outer region of epitaxial portion (B) having a higher silver bromide content in the epitaxial portion, occupy 100 to 50% (grain numerical ratio) of all the grains contained in the silver halide photographic emulsion. It is more preferred that such grains occupy 100 to 80% (grain numerical ratio) of all the grains contained in the emulsion. The ratio of inner region (A) to outer region (B) (in terms of silver quantity) is preferably in the range of 50:50 to 1:99, more preferably 30:70 to 5:95. The lower silver bromide content in the inner region (A) is preferably less than 30 mol %, and more preferably less than 20 mol %. The higher silver bromide content in the outer region (B) is preferably 30 mol % or more, more preferably 40 mol % or more, and much more preferably 50 mol % or more. The inner region (A) of the epitaxial portion may be present on one side of the main plane of the tabular grain (such as shown in FIG. 1), may be present on both sides of the tabular grain (such as shown in FIG. 3), or may be present from one side of the main plane, via the side face, to the other side of the main plane (such as shown in FIG. 4).

Furthermore, in the emulsion of the present invention, it is preferred that the halogen composition of epitaxial portions be intergranularly uniform. Providing that the average silver chloride content of epitaxial portions of each individual grain of the emulsion is CL mol %, it is preferred that with respect to 100 to 70% (grain numerical ratio) of all the grains contained in the emulsion, the silver chloride content of epitaxial portions of each individual grain be in the range of 0.7 to 1.3 CL. More preferably, the silver chloride content is in the range of 0.8 to 1.2 CL.

Also, providing that the average silver iodide content of epitaxial portions of each individual grain of the emulsion according to the present invention is I mol %, it is preferred that with respect to 100 to 70% (grain numerical ratio) of all the grains contained in the emulsion, the intragranular silver iodide content of epitaxial portions of each individual grain be in the range of 0.7 to 1.3 I. More preferably, the intragranular silver iodide content is in the range of 0.8 to 1.2 I.

Further, providing that the average silver bromide content of epitaxial portions of each individual grain of the emulsion according to the present invention is Br mol %, it is preferred that with respect to 100 to 70% (grain numerical ratio) of all the grains contained in the emulsion, the intragranular silver bromide content of epitaxial portions of each individual grain be in the range of 0.7 to 1.3 Br. More preferably, the intragranular silver bromide content is in the range of 0.8 to 1.2 Br.

The halogen composition of epitaxial portions can be investigated through, for example, an analytical electron microscope. In particular, the measurement can be carried out by obtaining a cross section of tabular grains perpendicular to the main planes in the following manner and irradiating the same with electron beams in the direction of section. Specifically, an emulsion sampled in the course of grain formation, a final grain emulsion obtained by completing the grain formation, or grains harvested from a photosensitive material by centrifugation are applied onto a triacetylcellulose support and covered with a resin. An about 50 nm thick section is cut from this specimen by means of an ultramicrotome, and mounted on a copper mesh overlaid with a support membrane. The measurement of silver chloride content and silver iodide content is carried out by performing a point analysis, with a spot diameter reduced to 2 nm or less, of given portions of these grains by means of an analytical electron microscope. The silver chloride content and silver iodide content can be calculated with reference to a calibration curve obtained in advance by treating silver halide grains of known contents in the above manner and determining the ratio of Ag intensity to Br, Cl or I intensity thereof. As an analytical radiation source for analytical electron microscope, a field emission type electron gun of high electron density is more suitable than a thermoelectronic one. The halogen composition of minute portions can be easily analyzed by reducing the spot diameter to 1 nm or less.

In the emulsion of the present invention, the amount of silver in an epitaxial portion (when a plural of epitaxial portions are present in a grain, the total amount thereof) is preferably in the range of 2 to 30 mol %, more preferably 3 to 20 mol %, based on the amount of silver in the host tabular grain.

The amount of silver in epitaxial portions can be estimated from an electron micrograph. First, the amount of silver in epitaxial portions can be estimated by multiplying the area of epitaxial portion exhibited when viewed in the direction of main planes of grains by the thickness of epitaxial portion exhibited when viewed in the direction of grain section. On the other hand, the amount of silver in host grain portions can be estimated by multiplying the area of host grain portion exhibited when viewed in the direction of main planes of grains by the thickness of host grain portion exhibited when viewed in the direction of grain section. The observation in the direction of grain section can be effected by forming a cross section of tabular grains perpendicular to the main planes in the following manner and observing in the direction of grain side face. Specifically, emulsion grains are sampled in the course of grain formation, and gelatin is removed therefrom by centrifugation. The resultant grains are applied onto a triacetylcellulose support and covered with a resin. An about 50 nm thick section is cut from the thus obtained specimen by means of an ultramicrotome, and mounted on a copper mesh overlaid with a support membrane. The mounted section is observed through a transmission electron microscope.

Also, the method of estimating the amount of silver by dissolving grains with a solvent, taking advantage of the solubility difference attributed to a difference in halogen composition between epitaxial portions and host grain portions, may be employed. In this method, first, those with higher solubility among epitaxial portions and host grain portions are dissolved with a weak solvent, and the amount of silver therein is measured by, for example, an atomic absorption measuring method. Further, the rest thereof is dissolved with a solvent, and the amount of silver therein is measured. Thus, the desired silver amount can be determined.

In the emulsion of the present invention, grains wherein a portion of an external surface of at least one silver halide epitaxial portion formed only on a corner portion(s) of each of the host tabular grains has a face parallel to the main planes of each of the host tabular grains, occupy 100 to 50% (grain numerical ratio) of all the grains contained in the emulsion. It is preferred that such grains occupy 100 to 80% (grain numerical ratio) of all the grains contained in the emulsion.

Further, in the emulsion of the present invention, grains wherein a portion of an external surface of at least one silver halide epitaxial portion formed only on a corner portion(s) of each of the host tabular grains has a {100} face, occupy 100 to 50% (grain numerical ratio) of all the grains contained in the emulsion. It is preferred that such grains occupy 100 to 80% (grain numerical ratio) of all the grains contained in the silver halide photographic emulsion.

The face parallel to the main planes of each of the host tabular grain and the {100} face may be present in the external surface of one epitaxial portion.

In the present invention, the configuration of silver halide epitaxial portions, although, for example, {110} face other than {111} and {100} faces may partially occur and also an amorphous form wherein high-order faces occur may be exhibited, is preferably homogeneous not only intragranularly but also intergranularly.

Figure 2:
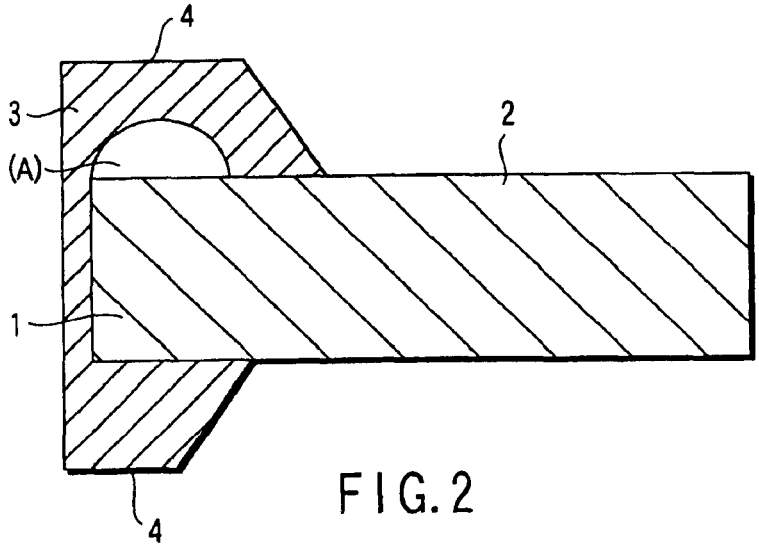
FIG. 2 is another example of another schematic view of a cross section, made perpendicularly to main planes of a host tabular grain, of the host tabular grain and an epitaxial portion formed on corner portion thereof.

Whether or not a portion of an external surface of silver halide epitaxial portions has a face parallel to the main planes of host tabular grains is judged by forming a cross section of tabular grains having epitaxial junction formed thereon perpendicular to the main planes in the following manner and observing in the direction of grain side face. Specifically, emulsion grains are centrifuged to thereby remove gelatin, and the resultant grains are applied onto a triacetylcellulose support and covered with a resin. An about 50 nm thick section is cut from the thus obtained specimen by means of an ultramicrotome, and mounted on a copper mesh overlaid with a support membrane. The grains formed into cross section are observed through a transmission electron microscope. In the determination of the proportion of these grains to all the grains contained in the silver halide photographic emulsion in the emulsion, it is preferred to observe at least 50 grains. One form of schematic view of the cross section is shown in FIG. 1, and other forms thereof are shown in FIGS. 2 to 4. It is to be noted that the tabular grains of the present invention are not limited to these. Referring to FIGS. 1 to 4, reference number 1 denotes a host tabular grain, and reference number 2 denotes a main plane of the host tabular grain. Reference number 3 denotes an epitaxial portion, and reference number 4 denotes a portion of the external surface of the epitaxial portion whose face index is {111}, namely, face parallel to the main plane of host tabular grain. Reference character (A) denotes an inner region, while the rest region in the epitaxial portion is an outer region (B).

Figure 5:
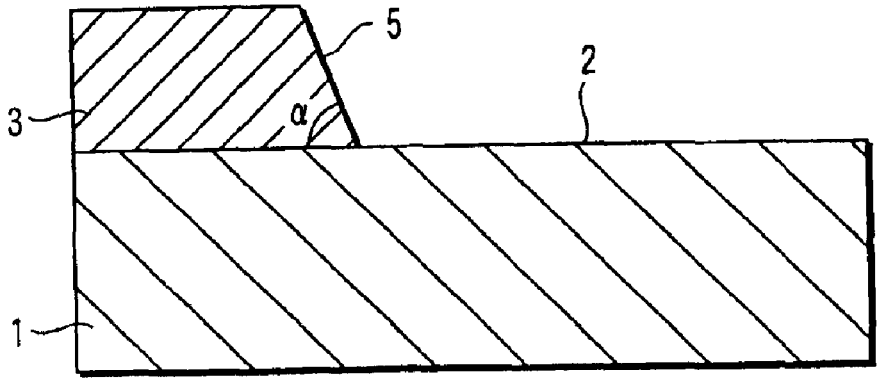
FIG. 5 is a further example of a schematic view of cross section, made perpendicularly to main planes of a host tabular grain, of the host tabular grain and an epitaxial portion formed on corner portion thereof.

Whether or not a portion of an external surface of silver halide epitaxial portion has {100} face is judged by identifying the direction of grain cut by using electron beam diffraction with respect to grains formed into a cross section in the above manner, thereafter carrying out observation through a transmission electron microscope in the above manner, and measuring the angle made by the main plane of host tabular grain and the external surface of epitaxial portion. In the determination of the proportion of these grains to all the grains contained in the silver halide photographic emulsion in the emulsion, it is preferred to observe at least 50 grains. Grain whose schematic view is given in FIG. 1 will be described below as an embodiment with reference to FIG. 5, which grain however in no way limits the tabular grains of the present invention. Referring to FIG. 5, reference numbers 1 to 4 are as defined above with respect to FIG. 1 and FIG. 2. Reference number 5 denotes a portion of an external surface of an epitaxial portion whose face index is {100}. Direction perpendicular to the sheet surface of this FIG. 5 is {110} (according to electron beam diffraction). The main plane 2 of host tabular grain is {111} face, and the angle a made by the main plane 2 and region 5 of the external surface of epitaxial portion whose face index is {100} is 55°. Generally, the value of a satisfied an inequality: $200<\alpha<80°$.

In the emulsion of the present invention, it is preferred that the {100} face also occur at the side face of host tabular grain. In the present invention, with respect to emulsion grains consisting of host tabular portion combined with epitaxial portion, the ratio of area wherein the {100} face occupies the emulsion grain surface to area wherein the {111} face occupies the emulsion grain surface is at least 2%, preferably 4% or higher.

With respect to the control of {100} face ratio of host tabular grains, reference can be made to, for example, JP-A's-2-298935 and 8-334850. The {100} face ratio can be determined by the method wherein the difference in adsorption dependency between {111} faces and {100} faces with respect to the adsorption of sensitizing dye is utilized, for example, the method described in T. Tani, J. Imaging Sci., 29, 165 (1985).

In the emulsion grains of the present invention, the {100} face a real ratio to the side faces of tabular grains is preferably 10% or higher, more preferably 20% or higher. The {100} face areal ratio to the side faces of tabular grains can be determined by, for example, the method described in JP-A-8-334850.

Now, the process for preparing silver halide grains will be described. The process for preparing a silver halide emulsion generally comprises forming silver halide nuclei and growing silver halide grains so as to obtain grains of desired size. In this respect, the process of the present invention is similar to the general process. The formation of tabular grains at least comprises nucleation, ripening and growing steps. These steps are described in detail in U.S. Pat. No. 4,945,037. The growing step comprises charging an aqueous solution of silver salt and a halogen salt solution to a reaction vessel according to the double jet technique so as to grow silver halide grain nuclei, which is however not limitary. In the growth according to the double jet technique, the method of controlling the pAg value of reaction solution can be employed.

The process for preparing a silver halide emulsion according to the present invention will be described in detail below.

The preparatory process of the present invention comprises a step of core portion formation (step (a)), a subsequent step of shell portion formation (step (b)) and a step of epitaxial portion formation (step (c)). Although it is basically preferred to carry out all the steps (a), (b) and (c), the step (b) can be avoided.

First, the step (a) being the step of core portion formation will be described. The step of core portion formation can be accomplished through steps generally well known in the art to which the present invention pertains, namely, a nucleation step—a ripening step—a growth step. The nucleation, ripening and growing steps will be described below.

1. Nucleation step The nucleation of tabular grains is in general carried out by a double jet method comprising adding an aqueous solution of silver salt and an aqueous solution of alkali halide to a reaction vessel containing a protective colloid aqueous solution, or a single jet method comprising adding an aqueous solution of silver salt to a protective colloid solution containing alkali halide. If necessary, a method comprising adding an aqueous solution of alkali halide to a protective colloid solution containing silver salt may be used. Further, if necessary, a method comprising adding a protective colloid solution, a silver salt solution and an aqueous solution of alkali halide to the mixer disclosed in JP-A-2-44335, and immediately transfer the mixture to a reaction vessel may be used for the nucleation of tabular grains. Further, as disclosed in U.S. Pat. No. 5,104,786, nucleation can be performed by passing an aqueous solution containing alkali halide and a protective colloid solution through a pipe and adding an aqueous solution of silver salt thereto.

Gelatin is used as protective colloid but natural high polymers besides gelatin and synthetic high polymers can also be used. Alkali-processed gelatin, oxidized gelatin, i.e., gelatin in which a methionine group in the gelatin molecule is oxidized with hydrogen peroxide, etc. (a methionine content of 40 $\mu$mol/g or less), amino group-modified gelatin of the present invention (e.g., phthalated gelatin, trimellitated gelatin, succinated gelatin, maleated gelatin, and esterified gelatin), and low molecular weight gelatin (weight average molecular weight of from 3,000 to 40,000) are used. Japanese Patent Application KOKOKU Publication No. (hereinafter also referred to as JP-B-)5-12696 can be referred to about oxidized gelatin. Descriptions of JP-A's-8-82883 and 11-143002 can be referred to about amino group-modified gelatin. Further, if necessary, lime-processed ossein gelatin containing 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. Further, natural high polymers will be described in JP-B-7-111550 and Research Disclosure, Vol. 176, No. 17643, item IX (December, 1978).

Presence of excessive halides during nucleation, usually, before nucleation and/or during nucleation is preferable. In this case, the excessive halides are preferably $Cl^-$, $Br^-$ and $I^-$, and they can be present individually or in combination. In the present invention, the presence of $Cl^-$ is preferable. The concentration of the total halides is preferably $3\times10^{-5}$ mol/L or more and 0.1 mol/L or less, and more preferably $3\times10^{-4}$ mol/L or more and 0.01 mol/L or less. The halogen composition in a halide solution added during nucleation is preferably $Br^-$, $Cl^-$, and $I^-$, and they can be present individually or in combination. In the present invention, the presence of $Cl^-$ is preferable. In this case, the chlorine content in silver halide nuclei after the formation of the nuclei is 5 mol % or more and 100 mol % or less, and 10 mol % or more and 80 mol % or less is more preferable. The protective colloid may be dissolved in a halide solution added during nucleation. The temperature in the nucleation is preferably from 5 to 60° C., but when fine tabular grains having an average grain diameter of 0.5 m or less are produced, the temperature is more preferably from 5 to 48° C. The pH of the dispersion medium when amino group-modified gelatin is used is preferably 4 or more and 8 or less but when other gelatins are used it is preferably 2 or more and 8 or less.

2. Ripening step In the nucleation described in 1 above, fine grains other than tabular grains are formed (in particular, octahedral and single twin grains). Accordingly, the grains other than tabular grains are necessary to be vanished before entering a growing step described infra to obtain nuclei having the forms of becoming tabular grains and good monodispersibility. For this purpose, it is well known that Ostwald ripening is conducted subsequent to the nucleation. The pBr is adjusted just after nucleation, then the temperature is raised and ripening is carried out until the hexagonal tabular grain ratio reaches the maximum. At this time, protective colloid may be added additionally. The concentration of protective colloid to the dispersion medium solution at this time is preferably 10% by weight or less. The above-described alkali-processed gelatin, amino group-modified gelatin, oxidized gelatin, low molecular weight gelatin, natural high polymers and synthetic high polymers can be used as additional protective colloids. Further, if necessary, lime-processed ossein gelatin containing 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used.

The temperature during ripening is from 40 to 80° C., preferably from 50 to 80° C., and the pBr is from 1.2 to 3.0. The pH is preferably 4 or more and 8 or less when amino group-modified gelatin is present, and preferably 2 or more and 8 or less when other gelatins are used. A silver halide solvent may be used for rapidly vanishing grains other than tabular grains. The concentration of the silver halide solvent at this time is preferably from 0.3 mol/L or less, more preferably 0.2 mol/L or less. According to this ripening, the tabular grains become almost 100%.

After the ripening is completed, if the silver halide solvent is unnecessary in the next growing stage, the silver halide solvent is removed as follows: (i) in the case of alkaline silver halide solvents such as $NH_3$, an acid having great solubility product with Ag+ such as $HNO_3$ is added to be nullified; and (ii) in the case of thioether based silver halide solvent, an oxidizing agent such as $H_2O_2$ is added to be nullified as disclosed in JP-A-60-136736. In the production method of an emulsion of the present invention, the completion of the ripening step is defined as a time of disappearance of grains other than those having hexagonal or triangular main planes which have two twin planes (i.e., regular or single twin grains). The disappearance of grains other than those having hexagonal or triangular main planes which have two twin planes can be confirmed through the observation of the TEM image of a replica of grains.

In the ripening step, an over-ripening step disclosed in JP-A-11-174606 may be provided, if necessary. The over-ripening step refers to a step where ripening (ripening step) is performed until the proportion of hexagonal tabular grains becomes maximum, and then the tabular grains subjected to Ostwald ripening, thereby eliminating tabular grains with a slow anisotropic growing rate. When letting the number of grains obtained in the ripening step be 100, it is preferable to reduce the number of tabular grains to 90 or less, and more preferable to reduce it to 60 or more and 80 or less.

In the production method of the emulsion of the present invention, conditions of pBr, temperature and the like during the over-ripening step may be set as in the ripening step. Further, in the over-ripening step, a silver halide solvent may be added as in the ripening step, and the kind, concentration and the like thereof may be set to those the same as in the ripening step.

3. Growing step The pBr during the crystal growing stage subsequent to the ripening step is preferably maintained at 1.4 to 3.5. When the concentration of protective colloid in a dispersion medium solution before entering the growing step is low (1% by weight or less), protective colloid is additionally added in some cases. Further, protective colloid may be additionally added during the growing step. The timing of the addition may be any time during the growing step. The concentration of protective colloid in a dispersion medium solution at that time is preferably from 1 to 10% by weight. The above-described alkali-processed gelatin, amino group-modified gelatin, oxidized gelatin, natural high polymers and synthetic high polymers can be used as additional protective colloids. Further, if necessary, lime-processed ossein gelatin containing 30% or more of components having a molecular weight of 280,000 in a molecular weight distribution determined by the Puggy's method disclosed in JP-A-11-237704 may be employed. Furthermore, for example, starches disclosed in EP No. 758758 and U.S. Pat. No. 5,733,718 may also be used. The pH during growing is preferably from 4 to 8 when amino group-modified gelatin is present, and preferably from 2 to 8 when other gelatins are used. The feeding rate of $Ag^+$ and a halogen ion in the crystal growing stage is preferably adjusted to such a degree that the crystal growing speed becomes from 20 to 100%, more preferably from 30 to 100%, of the critical growing speed of the crystal. In this case, the feeding rates of a silver ion and a halogen ion are increased with the crystal growth of the grains and, as disclosed in JP-B's-48-36890 and 52-16364, the feeding rates of an aqueous solution of silver salt and an aqueous solution of halide may be increased, alternatively, the concentrations of an aqueous solution of silver salt and an aqueous solution of halide may be increased. When performing by the double-jet method in which an aqueous silver salt solution and an aqueous halide salt solution are added simultaneously, it is preferable to stir in the reaction vessel well or to dilute the concentration of the solution to be added for preventing the introduction of growth dislocation due to ununiformity of iodine.

A method is more preferable in which an AgI fine grain emulsion prepared outside the reaction vessel is added to the same timing when an aqueous silver salt solution and an aqueous halide salt solution are added. Grain growth by the method in an amount of at least 50% of the total silver amount is preferable. In this case, the temperature of growth is preferably 50° C. or more and 90° C. or less, and more preferably 60° C. or more and 85° C. or less. The silver iodide fine grain emulsion may be that prepared in advance. Alternatively, a silver iodide fine grain emulsion may be added while being prepared continuously. In this case, with respect to the preparation method, JP-A-10-43570 is available as a reference. The average grain size of the silver iodide emulsion to be added is 0.01 μm or more and 0.1 μm or less, and preferably 0.02 μm or more and 0.08 μm or less. The iodine composition of the host grains can be varied by adjusting the amount of the AgI emulsion to be added. It is also possible to add silver iodobromide fine grains instead of adding an aqueous silver salt solution and an aqueous halide salt solution. In this case, host grains having a desired iodine composition are obtained by rendering the iodine amount of the fine grains equal to the iodine amount of the desired host grains. Although the silver iodobromide fine grains may be those prepared in advance, it is more preferable that the fine grains may be added while being prepared continuously. JP-A-10-43570 is available as a reference for the preparation method. The size of the silver iodobromide fine grains to be added is 0.005 μm or more and 0.05 μm or less, and preferably 0.01 μm or more and 0.03 μm or less. The temperature during the growth is 60° C. or more and 90° C. or less, and preferably from 70° C. to 85° C. It is also possible to combine the aforementioned ion adding method, the silver iodide fine grain adding method, and the silver iodobromide fine grain adding method.

Next, the step (b) being the step of shell portion will be described.

The shell portion may surround the whole core portion, or may surround only side faces of tabular grain of the core portion, or may surround only a main plane portion. The number of the shell may be one or may be two or more. When the number of the shell is two or more, the shell outside the core is called a first shell, the shell outside the first shell is called a second shell, and the outer shells are called a third shell and a fourth shell one by one. In the present specification, "the outermost shell" is the shell positioned at the outermost side. The shell portion may be divided into a plural of layers as mentioned above. The average iodide contents in each of the layers of the shell may be combined arbitrary from the range of 0 mol % or more to the solubility limit or less depending on purposes.

The growth of a shell is basically done with a double jet method by adding an aqueous solution of silver nitrate and an aqueous solution of halide containing iodide and bromide. Alternatively, the growth is done with a double jet method by adding an aqueous solution of silver nitrate aqueous and an aqueous halide solution containing iodide. Further, there is a method in which silver iodobromide or silver iodide fine grains are added, thereby ripen the grains to solve. Further, a silver halide phase containing silver iodide may be formed by abruptly arising iodide ions using iodide ion-releasing agent described in the specification of U.S. Pat. No. 5,496,694. Any one of the above methods may be used or may combine these. The silver iodide fine grains are preferably 100% silver iodide. The crystal structure of silver iodide can be a β body, a γ body, or, as described in U.S. Pat. No. 4,672,026, an α body or an α body similar structure. In the present invention, the crystal structure is not particularly restricted but is preferably a mixture of β and γ bodies, and more preferably, a β body. The silver iodide fine grain emulsion can be either an emulsion formed immediately before addition described in U.S. Pat. No. 5,004,679, or an emulsion subjected to a regular washing step. The silver iodide fine grains can be readily formed by a method described in, e.g., aforementioned U.S. Pat. No. 4,672,026. A double-jet addition method using an aqueous silver salt solution and an aqueous iodide salt solution in which grain formation is performed with a fixed pI value is preferred. The pI is the logarithm of the reciprocal of the $I^-$ ion concentration of the system. The temperature, pI, and pH of the system, the type and concentration of a protective colloid agent such as gelatin, and the presence/absence, type, and concentration of a silver halide solvent are not particularly limited. However, a grain size of preferably 0.1 μm or less, and more preferably, 0.07 μm or less is convenient for the present invention.

The silver iodobromide fine grains may be that prepared in advance as described above, but preferably, silver iodobromide fine grains are added while being prepared continuously outside the reaction vessel. The preparation method may refer to the publication of JP-A-10-43570. The grain size of the silver iodobromide fine grains to be added is 0.005 μm or more and 0.05 μm or less, and preferably 0.01 μm or more and 0.03 μm or less.

Next, the step (c) being the step of epitaxial portion formation will be described.

In the present invention, as site directors that are used for the formation of the epitaxial portion, aminoazaindene or spectral sensitizing dyes may be used, or iodide ions or thiocyanate ions may be used. These may be properly used depending on the purposes and may be use in combination. By varying the addition amounts of the sensitizing dyes, iodide ions and thiocyanate ions, the site for forming silver salt epitaxial portion can be limited only to the main plane portions, the side face portions or the apex portions of tabular grains. Combinations of them are also possible. It is preferable that the amounts of aminoazaindene, iodide ions, thiocyanate ions and spectral sensitizing dyes that are used as site directors are suitably selected depending on the silver amount, the surface area and the formation position of the epitaxial portion of the silver halide tabular grains to be used.

When spectral sensitizing dyes are used, the formation position of the epitaxial portion may be controlled by selecting the amount and type of the dyes. The dyes are preferably added in an amount of 50% to 90% of the saturated covering amount. Examples of employed dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes. Any of nuclei commonly used in cyanine dyes as basic heterocyclic nuclei can be employed in these dyes. That is, there can be employed, for example, a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzoimidazole nucleus and a quinoline nucleus. These nuclei may have substituents on carbon atoms thereof.

The sensitizing dyes may be used alone or may be used in combination. The combined use of the sensitizing dyes is often used especially for supersensitization. Representative ones are described in the specifications of U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, GB's 1,344,281 and 1,507,803, and publications of JP-B-43-4936 and 53-12375, JP-A-52-110618 and 52-109925. A dye that has no spectral sensitizing function in itself or a substance that substantially does not absorb visible light but exhibit supersensitization may be added simultaneously with a sensitizing dye or separately.

Further, the present invention is preferably used together with a technique of increasing light absorptivity by a spectrum sensitizing dye. For example, there is a method, by utilizing an intermolecular force, of causing more sensitizing dyes to adsorb to silver halide grain surfaces in comparison with those in a single-layer saturated absorption (that is, one-layer adsorption), or a method of adsorbing, to silver halide grains, a coupling dye having two or more chromophores which are not separately conjugated but coupled by a covalent bond. Among them, the present invention is preferably used together with the techniques disclosed in the following patent documents:

JP-A's-10-239789, 11-133531, 2000-267216, 2000-275772, 2001-75222, 2001-75247, 2001-75221, 2001-75226, 2001-75223, 2001-255615, 2002-23294, 10-171058, 10-186559, 10-197980, 2000-81678, 2001-5132, 2001-166413, 2002-49113, 64-91134, 10-110107, 10-171058, 10-226758, 10-307358, 10-307359, 10-310715, 2000-231174, 2000-231172, 2000-231173, and 2001-356442, and EP's 985965A, 985964A, 985966A, 985967A, 1085372A, 1085373A, 1172688A, 1199595A, and 887700A1.

The temperature at which silver salt epitaxial is formed is preferably 30 to 70° C., and more preferably 35 to 60° C. At this time, pAg is preferably 9.0 or less, and more preferably 8.0 or less. At this time, pH is preferably 3.0 to 8.0, and more preferably 4.0 to 7.0. In this way, the silver salt epitaxial can be selectively formed (i.e., formed only at each portion) on the main plane portion, the side face portion or the corner portion of the tabular grain, by properly selecting the type and the addition amount of the site-director, and the condition for epitaxial deposition (the temperature, pAg, pH and etc.).

After the addition of site director, the formation of epitaxial portions can be accomplished by simultaneously adding an aqueous solution of silver salt and an aqueous solution of halogen salt, or by first adding an aqueous solution of halogen salt and thereafter adding an aqueous solution of silver salt. Further, the formation of epitaxial portions can be accomplished by adding an aqueous solution of halogen salt and thereafter simultaneously adding an aqueous solution of silver salt and an aqueous solution of halogen salt.

The formation of epitaxial portions may be performed in some divisions with the pAg and pH values at formation of epitaxial portions varied, or may be performed in some divisions with halogen salt compositions varied. Performing the formation of epitaxial portions in some divisions with halogen compositions varied is preferred. In the formation of epitaxial portions with halogen compositions varied, an aqueous solution of silver salt and an aqueous solution of halogen salt may be added simultaneously, or only an aqueous solution of halogen salt may be added. Alternatively, an aqueous solution of silver salt and an aqueous solution of halogen salt may be simultaneously added after the addition of an aqueous solution of halogen salt. Still alternatively, use may be made of a method wherein in a mixer other than that for reaction solution an aqueous solution of silver salt and an aqueous solution of halogen salt are mixed together to thereby form fine grains of silver halides and wherein the fine grains are placed in a reaction vessel so that formation of epitaxial portions is carried on. Yet still alternatively, use may be made of a method wherein silver halide fine grains having been prepared in advance are placed in a reaction vessel so that formation of epitaxial portions is carried on.

The operation of forming epitaxial portions may be continuously performed after the formation of tabular grains. After the formation of tabular grains, the tabular grains may be washed/re-dispersed before subjecting to formation of epitaxial portions. The operation of forming epitaxial portions may be performed before chemical sensitization. The formation of epitaxial portions effected in some divisions may be continuously performed during the process of silver halide formation, or may be performed after washing/re-dispersion, or may be performed before chemical sensitization. The formation of epitaxial portions may be performed in divisions of before and after washing/re-dispersion.

In the emulsion of the present invention, it is preferred that 100 to 50% (grain numerical ratio) of all the grains contained in the emulsion be occupied by tabular grains in each of which there is at least one dislocation line in at least one epitaxial portion. More preferably, 100 to 80% (grain numerical ratio) of all the grains contained in the emulsion are occupied by such tabular grains. It is preferred that dislocation lines occurring in epitaxial portions be present at high density. Although a network dislocation line might be introduced in the epitaxial portions, it is one composed of a network crossing of a plurality of such dislocation lines as cannot be counted as definite lines and is preferable.

In tabular grains having a plurality of epitaxial portions, although it is preferred that a dislocation line be present in each of the epitaxial portions, it is not always necessary to have all the epitaxial portions provided with a dislocation line and it is satisfactory to cause at least one epitaxial portion to contain at least one dislocation line. With respect to the number of dislocation lines in epitaxial portion, however, the higher the density, and the higher the intragranular and intergranular homogeneity, the greater the preference. Further, in the present invention, dislocation lines may be present in portions other than the epitaxial portions.

The dislocation lines of tabular grains can be observed by a direct method in a low temperature using a transmission electron microscope, described in J. F. Hamilton, Phot. Sci. Eng., 11, 57,(1967) and T. Shiozawa, J. Soc. Phot. Sci. Japan, 35, 213 (1972), for example. Specifically, silver halide grains taken out from the emulsion with care so as not to apply strong pressure to the grains to generate new dislocation lines are put on a mesh for electron microscope observation. Then, the sample is observed by transmission electron radiography in the state where the sample is cooled to prevent damage (e.g., printout) by electron beam, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes. In the present invention, it is preferable that the rate of grains having a dislocation line and the number of dislocation line are obtained by directly observing at least 100 grains with an electron microscope (with 400 kV or more accelerating voltage).

In the present invention, it is preferable that a hexa-cyano metal complex is doped during the formation of the epitaxial portion. Among the hexa-cyano metal complex, those containing iron, ruthenium, osmium, cobalt, rhodium, iridium or chromium are preferable. The addition amount of the metal complex is preferably within the range of $10^{-9}$ to $10^{-2}$ per mol of silver halide (the total of the epitaxial portion and the host portion), and more preferably within the range of $10^{-8}$ to $10^{-4}$ mol. The metal complex may be added by dissolving it to water or a organic solvent. The organic solvent is preferably miscible with water. As examples of the organic solvent, alcohols, ethers, glycols, ketones, esters, and amides are included.

As the metal complexes, hexa-cyano metal complexes represented by the following formula (I) is especially preferable. The hexa-cyano metal complex has advantages of attaining high-sensitive photosensitive material, and suppressing fogging from arising even when a raw photosensitive material is stored for a long period of time.

$$[M(CN)_6]^{n-} \quad (I)$$

wherein M represents iron, ruthenium, osmium, cobalt, rhodium, iridium or chromium, and n represent 3 or 4.

Specific examples of the hexa-cyano metal complexes are set forth below:

| | |
|---|---|
| (I-1) | $[Fe(CN)_6]^{4-}$ |
| (I-2) | $[Fe(CN)_6]^{3-}$ |
| (I-3) | $[Ru(CN)_6]^{4-}$ |
| (I-4) | $[Os(CN)_6]^{4-}$ |
| (I-5) | $[Co(CN)_6]^{3-}$ |
| (I-6) | $[Rh(CN)_6]^{3-}$ |
| (I-7) | $[Ir(CN)_6]^{3-}$ |
| (I-8) | $[Cr(CN)_6]^{4-}$ |

For the counter cations of the hexa-cyano complex, those easily miscible with water, and suitable for precipitation procedure of a silver halide emulsion are preferably used. Examples of the counter ions includes alkali metal ions (e.g. sodium ion, potassium ion, rubidium ion, cesium ion and lithium ion), ammonium ion and alkylammonium ion.

In the present invention, washing may be performed before epitaxial deposition, or thereafter.

Although washing can be effected by the method described in RD, vol. 176, No. 17643, item II, it is preferred to accomplish washing by performing desalting and/or concentrating through ultrafiltration and/or electrodialysis.

The terminology "ultrafiltration" is used in accordance with the definition given in M. Cheyan "Ultrafiltration Handbook" (Technomic Publishing Company, Inc., 1986). In the method of ultrafiltration, a membrane is generally used, which membrane allows unnecessary substances to pass therethrough. For example, in the process for producing a silver halide emulsion, ultrafiltration provides a method of purification wherein use is made of a membrane that prevents the passage of necessary substances such as silver halide grains but allows unnecessary salts, etc. to pass therethrough.

Furthermore, the method of ultrafiltration involves washing and/or concentrating of silver halide emulsions so as to remove excess soluble salts. The washing and/or concentrating is performed by causing a dispersed silver halide emulsion to pass through a pressurized ultrafiltration module so that unnecessary salts are allowed to pass through a semipermeable membrane while obtaining residue (emulsion) composed of silver halide grains and a dispersant. Practically, an ultrafiltration unit described in JP-A-2002-122952 can preferably be used.

Chemical sensitization is preferably performed for the emulsion of the invention after the formation of the epitaxial portion. One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the case of gold sensitization, known compounds such as chloroauric acid, potassium chloroaurate, potassium auricthiocyanate, gold sulfide and gold selenide may be used. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing speed in the process of chemical sensitization. Examples of the chemical sensitization aid and the modifier are described in U.S. Pat. Nos. 2,131,038, 3,411,914, and 3,554,757, JP-A-58-126526, and G. F. Duffin, Photographic Emulsion. Chemistry, pages 138 to 143.

It is preferable for the present emulsion that gold sensitization is performed in combination. A preferable amount of a gold sensitizer is $1\times10^{-4}$ to $1\times10^{-7}$ mol, and more preferably, $1\times10^{-5}$ to $5\times10^{-7}$ mol per mol of silver halide. Preferable range of the palladium compound is $1\times10^{-3}$ to $5\times10^{-7}$ per mol of silver halide. Preferable range of the thiocyan compound or selenocyan compound is $5\times10^{-2}$ to $1\times10^{-6}$ mol per mol of silver halide.

Preferable amount of sulfur sensitizer used for the silver halide grains for use in the present invention is $1\times10^{-4}$ to $1\times10^{-7}$ mol, more preferably $1\times10^{-5}$ to $5\times10^{-7}$ per mol of silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

In the tellurium sensitization, labile tellurium compounds, such as hose described in the publications of JP-A's-4-22459, 4-271341, 4-333043, 5-303157, 6-27573, 6-175258, 6-180478, 6-208184, 6-208186, 6-317867, 7-140579, 7-301879, and 7-301880, may be used.

More specifically, phosphinetellurides (e.g., n-butyldiisopropylphosphinetelluride, triisobutylphosphinetelluride, tri-n-butoxyphosphinetelluride, triisopropylphosphinetelluride), diacyl(di)telluride (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride), telluroureas (e.g., N,N'-dimethylethylenetellurourea), telluroamides, telluroesters may be used. Preferably, phosphynetellurides and diacyltellurides may be used.

Further, it is also preferable to use the techniques described in the following patent publications in combination. JP-A's-10-239789, 2001-75222 and 10-171058. It is also possible to use fragmentable electron-donating sensitizers. The electron-donating sensitizers are described in the specifications and publications of U.S. Pat. Nos. 5,747,235, 5,747,236, 6,054,260 and 5,994,051, EP's 786692A1 and 893732A1, JP-A's-2000-181001, 2000-180999, 2000-181002, 2000-18100, 2000-221626 and 2000-221628. The fragmentable electron-donating sensitizers may be used at any time during photosensitive material preparation. For example, they can be used during grain formation, in a desalting step, during chemical sensitization, and before coating. The electron-donating sensitizers may be separately added in a plurality of times during the steps. The compound of the present invention is preferably added by dissolving it to water or a water soluble solvent such as methanol or ethanol, or solvent mixtures of these. When the compound is to be dissolved into water and the solubility of the compound increases by setting the lower or higher pH, the compound may be added after heightening or lowering the pH thereby to dissolve it to water. The fragmentable electron-donating sensitizer is preferably used in an emulsion layer. The electron-donating sensitizers may be added to a protective layer and an intermediate layer together with an emulsion layer, thereby diffusing the sensitizer during coating. The addition timing of the compound is irrespective of before or after the addition of a sensitizing dye, and a preferable amount contained in a silver halide emulsion layer is in a rate of $1\times10^{-9}$ to $5\times10^{-2}$ mol per mol of silver, and a more preferable amount is $1\times10^{-8}$ to $2\times10^{-3}$ mol. When the fragmentable electron-donating sensitizer is used, a preservability-improving agent is preferably added. Preferable compound used as the preservability-improving agents are those described in JP-A's-11-119364 and 2001-42466.

Photographic emulsions used in the present invention can contain various compounds in order to prevent fog during the preparation process, storage, or photographic processing of a sensitized material, or to stabilize photographic properties. That is, it is possible to add many compounds known as antifoggants or stabilizers, e.g., thiazoles such as benzothiazolium salt; nitroimidazoles; nitrobenzimidazoles; chlorobenzimidazoles; bromobenzimidazoles; mercaptothiazoles; mercaptobenzothiazoles; mercaptobenzimidazoles; mercaptothiadiazoles; aminotriazoles; benzotriazoles; nitrobenzotriazoles; and mercaptotetrazoles (particularly 1-phenyl-5-mercaptotetrazole); mercaptopyrimidines; mercaptotriazines; a thioketo compound such as oxazolinethione; azaindenes such as triazaindenes, tetrazaindenes (particularly 4-hydroxy-substituted(1,3,3a,7)tetrazaindenes), and pentazaindenes. For example, compounds described in the specifications of U.S. Pat. Nos. 3,954,474 and 3,982,947 and the publication of JP-B-52-28660 can be used. One preferred compound is described in JP-A-63-212932. Antifoggants and stabilizers can be added at any of several different timings, such as before, during, and after grain formation, during washing with water, during dispersion after the washing, during epitaxial formation, before, during, and after chemical sensitization, and before coating, in accordance with the intended application. The antifoggants and stabilizers can be added during preparation of an emulsion to achieve their original fog preventing effect and stabilizing effect. In addition, the antifoggants and stabilizers can be used for various purposes of, e.g., controlling the crystal habit of grains, decreasing the grain size, decreasing the solubility of grains, controlling chemical sensitization, and controlling the arrangement of dyes.

In the preparation of the emulsion of the invention other than the time of forming epitaxial, it is preferable to make salt of metal ion exist, for example, during grain formation, desalting, or chemical sensitization, or before coating in accordance with the intended use. The metal ion salt is preferably added during grain formation when doped into grains, and after grain formation and before completion of chemical sensitization when used to decorate the grain surface or used as a chemical sensitizer. The salt can be doped in any of an overall grain, only the core portion, and only the shell portion. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroxide, hexa-coordinated complex salt, or tetra-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous hydrogen halogenide solution (e.g., HCl or HBr) or an alkali halide (e.g., KCl, NaCl, KBr, or NaBr) can be added. It is also possible to add acid or alkali if necessary. The metal compounds can be added to a reactor vessel before grain formation or during the grain formation. Alternatively, the metal compounds can be added to a water-soluble silver salt (e.g., $AgNO_3$) or an aqueous alkali halide solution (e.g., NaCl, KBr, or KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

The silver halide emulsion of the invention preferably contains a grain with a positive hole-capturing zone in at least a portion of the inside of the silver halide grains by performing reduction sensitization during grain formation or after grain formation. The positive hole-capturing zone of the invention indicates a region having a function of capturing a positive hole generated in pair with photo-electron generated by, for example, photo-excitation. As the method of providing the positive hole-capturing zone like this, there is a method of using a dopant. In the present invention, the positive hole-capturing zone is preferably provided by an intentional reduction sensitization. As a method of reduction sensitization, any method selected from a method of adding a reduction sensitizer to a silver halide emulsion, a method of growing or ripening in a low pAg atmosphere such as is pAg of 1 to 7, which is called a silver ripening, and a method of growing or ripening in a high pH atmosphere such as pH of 8 to 11, which is called a high pH ripening. Also, two or more methods can be used in combination.

The intentional reduction sensitization in the present invention means an operation of introducing a positive hole-capturing silver nuclei into a portion or all of the inside of the silver halide grains by adding a reduction sensitizing agent. The positive hole-capturing silver nuclei means a small silver nuclei having a little development activity, and the recombination loss at a lightsensitive processing is prevented by the silver nuclei and the speed can be enhanced.

The method of adding a reduction sensitizer is a preferable method in view of nicely adjusting the level of reduction sensitization. Examples of known reduction sensitizers include stannous salts, ascorbic acid and derivatives thereof, amines and polyamines, hydrazine derivatives, formamidinesulfinic acid, silane compounds and borane compounds. In the reduction sensitization employed in the present invention, appropriate one may be selected from among these known reduction sensitizers and used or at least two may be selected and used in combination. Preferred reduction sensitizers are stannous chloride, thiourea dioxide, dimethylaminoborane, ascorbic acid and derivatives thereof. Although the addition amount of reduction sensitizer must be selected because it depends on the emulsion manufacturing conditions, it is preferred that the addition amount range from $10^{-7}$ to $10^{-3}$ mol per mol of silver halide. The reduction sensitizer is dissolved in water or any of organic solvents such as alcohols, glycols, ketones, esters and amides and added during the grain growth.

An oxidizer capable of oxidizing silver is preferably used during the process of producing the emulsion for use in the present invention. The silver oxidizer is a compound having an effect of acting on metallic silver to thereby convert the same to silver ion. A particularly effective compound is one that converts very fine silver grains, formed as a by-product in the step of forming silver halide grains and the step of chemical sensitization, into silver ions. Each silver ion produced may form a silver salt sparingly soluble in water, such as a silver halide, silver sulfide or silver selenide, or may form a silver salt easily soluble in water, such as silver nitrate. The silver oxidizer may be either an inorganic or an organic substance. Examples of suitable inorganic oxidizers include ozone, hydrogen peroxide and its adducts (e.g., $NaBO_2.H_2O_2.3H_2O$, $2NaCO_3.3H_2O_2$, $Na_4P_2O_7.2H_2O_2$ and $2Na_2SO_4.H_2O_2.2H_2$), peroxy acid salts (e.g., $K_2S_2O_8$, $K_2C_2O_6$ and $K_2P_2O_8$), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2H_4)_2].6H_2O$), permanganates (e.g., $KMnO_4$), chromates (e.g., $K_2Cr_2O_7$) and other oxyacid salts, halogen elements such as iodine and bromine, perhalogenates (e.g., potassium periodate), salts of high-valence metals (e.g., potassium hexacyanoferrate (II)) and thiosulfonates.

Examples of suitable organic oxidizers include quinones such as p-quinone, organic peroxides such as peracetic acid and perbenzoic acid and active halogen-releasing compounds (e.g., N-bromosuccinimide, chloramine T and chloramine B).

Oxidizers preferred in the present invention are inorganic oxidizers selected from among ozone, hydrogen peroxide and its adducts, halogen elements and thiosulfonates and organic oxidizers selected from among quinones. The combined use of the above mentioned reduction sensitization and oxidizer to silver is a preferable embodiment. The method to be used can be selected from among a method of performing reduction sensitization after the use of an oxidizer, a method of vice versa and a method of co-existing the both. These methods can be used at any time selected from a grain formation step and chemical sensitization step.

The silver halide photosensitive material that is prepared by using the silver halide emulsion of the present invention should have at least one lightsensitive layer on a support. Preferably, the photosensitive material is provided with at least one blue-sensitive emulsion layer, at least one green-sensitive emulsion layer, and at least one red-sensitive layer on a support, and at least one of blue-, green- and red-sensitive layers is composed of two or more layers having different speeds to each other. The numbers of a silver halide emulsion layer and a non photosensitive emulsion layer, and the arrangement order thereof are not particularly limited. A typical example of the photographic material is the one having at least one color-sensitive layer composed of a plurality of silver halide emulsion layers having substantially the same color sensitivity but different in speed, on a support. The color-sensitive layer is a unit lightsensitive layer having color-sensitivity of any one of glue light, green light and red light. In a multi-layered silver halide color photographic light sensitive material, the unit color sensitive layer is generally arranged in the order of red color-sensitive layer, green color-sensitive layer and blue color-sensitive layer from the support. However, the arrangement order may be reversed depending on the purpose thereof. Also, an arrangement order in which a different color-sensitive layer is interposed between color-sensitive layers having the same color-sensitivity, is also possible.

A non lightsensitive layer such as an inter layer may be provided with between the silver halide lightsensitive layers and in the uppermost and lowermost layers. In the inter layer, DIR compounds and couplers such as described in JP-A's-61-43748, 59-113438, 59-113440, 61-20037, and 61-20038, the entire contents of all of which are incorporated by reference, and a color-mixing inhibitor may be contained as usually do so.

A two-layer structure of high- and low-speed emulsion layers can be preferably used for a plurality of silver halide emulsion layers constituting each unit lightsensitive layer, as described in DE (German Patent) 1,121,470 or GB 923,045, the entire contents of both of which are incorporated by reference. Usually, the layers are preferably arranged such that the speed thereof decreases sequentially toward the support. A non lightsensitive layer may also be interposed between each silver halide emulsion layer. Also, as described in JP-A's-57-112751, 62-200350, 62-206541 and 62-206543, the entire contents of all of which are incorporated by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the entire contents of which are incorporated by reference, layers can be arranged from the farthest side from a support in the order of blue-sensitive layer/GH/RH/GL/RL. Furthermore, as described in JP-A's-56-25738 and 62-63936, the entire contents of both of which are incorporated by reference, layers can be arranged from the farthest side from a support in the order of blue-sensitive layer/GL/RL/GH/RH.

As described in JP-B-49-15495, the entire contents of which are incorporated by reference, three layers can be arranged such that a silver halide emulsion layer having the highest speed is arranged as an upper layer, a silver halide emulsion layer having speed lower than that of the upper layer is arranged as an interlayer, and a silver halide emulsion layer having speed lower than that of the interlayer is arranged as a lower layer; i.e., three layers having different sensitivities can be arranged such that the speed is sequentially decreased toward the support. Even when a layer structure is constituted by three layers having different speed, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference. Also in the case when the layer structure is constituted by four or more layers, the layer arrangement may be changed as mentioned above. As described above, various layer structures and arrangements may be selected depending on the purposes of respective photosensitive materials.

In addition, the order of high-speed emulsion layer/low-speed emulsion layer/medium-speed emulsion layer or low-speed emulsion layer/medium-speed emulsion layer/high-speed emulsion layer can be adopted.

A layer in which an emulsion of the present invention is used may be any of a low-speed emulsion layer, medium-speed emulsion layer and high-speed emulsion layer. Tabular grain emulsion provided with a dislocation line in the fringe portion as described in the publications of JP-A's-11-174606 and 11-295832, the entire contents of both of which are incorporated by reference, are preferably used as an emulsion having no epitaxial portion. This method of using enables to enhance photosensitive properties, while to reduce the coating silver amount. The silver amount (the weight in units of silver atoms) of an emulsion used in each emulsion layer is preferably 0.3 to 3 $g/m^2$, and more preferably, 0.5 to 2 $g/m^2$.

As described above, various layer arrangements and orders can be selected in accordance with the purpose of a photosensitive material.

The diverse additives described above are used in a photosensitive material according to the present invention. In addition, various other additives can be used in accordance with the intended use.

The additives are described in detail in Research Disclosure Item 17643 (December 1978), Item 18716 (November 1979) and Item 308119 (December 1989), the entire contents of all of which are incorporated herein by reference. A summary of the locations where they are described will be listed in the following table.

| | Types of additives | RD17643 | RD18716 | RD308119 |
|---|---|---|---|---|
| 1 | Chemical sensitizers | page 23 right column | page 648 | page 996 |
| 2 | Sensitivity-increasing agents | same as above | | |
| 3 | Spectral sensitizers, super-sensitizers | pages 23–24 | page 648, right column to page 649, right column | page 996, right column to page 998, right column |
| 4 | Brighteners | page 24 | page 647, right column | page 998, right column |
| 5 | Antifoggants, stabilizers | pages 24–25 | page 649 right column | page 998, right column to page 1000, right column |
| 6 | Light absorbents, filter dyes, ultraviolet absorbents | pages 25–26 | page 649, right column to page 650, left column | page 1003, left column to page 1003, right column |
| 7 | Stain preventing agents | page 25, right column | page 650, left to right columns | page 1002, right column |
| 8 | Dye image stabilizers | page 25 | | page 1002, right column |
| 9 | Film hardeners | page 26 | page 651, left column | page 1004, right column to page 1005, left column |
| 10 | Binders | page 26 | same as above | page 1003, right column to page 1004, right column |
| 11 | Plasticizers, lubricants | page 27 | page 650, right column | page 1006, left to right columns |
| 12 | Coating aids, surfactants | pages 26–27 | same as above | page 1005, left column to page 1006, left column |
| 13 | Antistatic agents | page 27 | same as above | page 1006, right column to page 1007, left column |
| 14 | Matting agents | | | page 1008, left column to page 1009, left column |

In order to inhibit deterioration in photographic properties due to formaldehyde gas, a compound capable of reacting with and solidifying formaldehyde as disclosed in U.S. Pat. Nos. 4,411,987 and 4,435,503 can be incorporated in the photosensitive material.

Various color couples may be used in the present invention, and the specific examples thereof are described in the patents described in the patents described in the aforementioned Research Disclosure No. 17643, VII-C to G and No. 307105, VII-C to G.

Preferred yellow couplers are those described in, for example, U.S. Pat. Nos. 3,933,051, 4,022,620, 4,326,024, 4,401,752 and 4,248,961, JP-B-58-10739, GB's 1,425,020 and 1,476,760, U.S. Pat. Nos. 3,973,968, 4,314,023 and 4,511,649, and EP 249,473A.

Particularly preferred magenta couplers are 5-pyrazolone and pyrazoloazole compounds. Particularly preferred are those described in U.S. Pat. Nos. 4,310,619 and 4,351,897, EP 73,636, U.S. Pat. Nos. 3,061,432 and 3,725,067, Research Disclosure No. 24220 (June, 1984), JP-A-60-33552, Research Disclosure No. 24230 (June, 1984), JP-A's-60-43659, 61-72238, 60-35730, 55-118034 and 60-185951, U.S. Pat. Nos. 4,500,630, 4,540,654 and 4,556,630, and International Publication No. WO 88/04795.

The cyan couplers usable in the present invention are phenolic and naphtholic couplers. Particularly preferred are those described in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Unexamined Published Application No. 3,329,729, EP's 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658.

Typical examples of the polymerized color-forming couplers are described in, for example, U.S. Pat. Nos. 3,451,820, 4,080,211, 4,367,282, 4,409,320 and 4,576,910, GB 2,102,137 and EP 341,188A.

The couplers capable of forming a colored dye having a suitable diffusibility are preferably those described in U.S. Pat. No. 4,366,237, GB 2,125,570, EP 96,570 and West German Patent (Publication) No. 3,234,533.

Colored couplers used for compensation for unnecessary absorption of the colored dye are preferably those described in Research Disclosure No. 17643, VII-G and No. 307105, VII-G, U.S. Pat. No. No. 4,163,670, JP-B-57-39413, U.S. Pat. Nos. 4,004,929 and 4,138,258 and GB 1,146,368. Other couplers preferably used herein include couplers capable of compensating for an unnecessary absorption of the colored dye with a fluorescent dye released during the coupling as described in U.S. Pat. No. 4,774,181 and couplers having, as a removable group, a dye precursor group capable of forming a dye by reacting with a developing agent as described in U.S. Pat. No. 4,777,120.

Further, compounds which release a photo-graphically useful residue during a coupling reaction are also preferably usable in the present invention. DIR couplers which release a development inhibitor are preferably those described in the patents shown in the above described RD 17643, VII-F and No. 307105, VII-F as well as those descried in JP-A's-57-151944, 57-154234, 60-184248, 63-37346 and 63-37350 and U.S. Pat. Nos. 4,248,962 and 4,782,012.

The couplers which release a nucleating agent or a development accelerator in the image-form in the development step are preferably those described in GB's 2,097,140 and 2,131,188 and JP-A's-59-157638 and 59-170840. Further, compounds capable of releasing a fogging agent, development accelerator, solvent for silver halides, etc. upon the oxidation-reduction reaction with an oxidation product of a developing agent as described in JP-A's-60-107029, 60-252340, 1-44940 and 1-45687 are also preferred.

Other compounds usable for the photosensitive material according to the present invention include competing couplers described in U.S. Pat. No. 4,130,427, polyequivalent couplers described in U.S. Pat. Nos. 4,283,472, 4,338,393 and 4,310,618, DIR redox compound-releasing couplers, DIR coupler-releasing couplers, DIR coupler-releasing redox compounds and DIR redox-releasing redox compounds described in JP-A's-60-185950 and 62-24252, couplers which release a dye that restores the color after coupling-off as described in EP's 173,302A and 313,308A, bleach-accelerating compound-releasing couplers as described in RD Nos. 11449 and 24241, ligand-releasing couplers described in U.S. Pat. No. 4,555,477, leuco dye-releasing couplers described in JP-A-63-75747 and fluorescent dye-releasing couplers described in U.S. Pat. No. 4,774,181.

The couplers used in the present invention can be incorporated into the photosensitive material by various known dispersion methods.

High-boiling solvents used for an oil-in-water dispersion method are described in, for example, U.S. Pat. No. 2,322,027.

The high-boiling organic solvents having a boiling point under atmospheric pressure of at least 175° C. and usable in the oil-in-water dispersion method include, for example, phthalates (such as dibutyl phthalate, dicyclohexyl phthalate, di-2-ethylhexyl phthalate, decylphthalate, bis(2,4-di-tert-amylphenyl) phthalate, bis(2,4-di-tert-amylphenyl) isophthalate and bis(1,1-diethylpropyl)phthalate); phosphates and phosphonates (such as triphenyl phosphate, tricresyl phosphate, 2-ethylhexyldihenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphate); benzoates (such as 2-ethylhexyl benzoate, dodecyl benzoate and 2-ethylhexyl-p-hydroxybenzoate); amides (such as N,N-di ethyldodecaneamide, N,N-diethyllaurylamide and N-tetradecylpyrrolidone); alcohols and phenols (such as isostearyl alcohol and 2,4-di-tert-amylphenol); aliphatic carboxylates (such as bis(2-ethylhexyl) sebacate, dioctyl azelate, glycerol tributyrate, isostearyl lactate and trioctyl citrate); aniline derivatives (such as N,N-dibutyl-2-butoxy-5-tert-octylaniline; and hydrocarbons (such as paraffin, dodecylbenzene and diisopropylnaphthalene). Co-solvents usable in the present invention include, for example, organic solvents having a boiling point of at least about 30° C., preferably 50° C. to about 160° C. Typical examples of them include ethyl acetate, butyl acetate, ethyl propionate, methyl ethyl ketone, cyclohexanone, 2-ethoxyethyl acetate and dimethylformamide.

The steps and effects of the latex dispersion method and examples of the latices usable for the impregnation are described in, for example, U.S. Pat. Nos. 4,199,363 and West German Patent Application (OLS) Nos. 2,541,274 and 2,541,230.

The color photosensitive material used in the present invention preferably contains phenethyl alcohol or an antiseptic or mold-proofing agent described in JP-A's-63-257747, 62-272248 and 1-80941 such as 1,2-benzoisothiazolin-3-one, n-butyl p-hydroxybenzoate, phenol, 4-chloro-3,5-dimethylphenol, 2-phenoxyethanol or 2-(4-thiazolyl) benzimidazole.

The present invention is applicable to various color photosensitive materials such as ordinary color negative films, cinema color negative films, reversal color films for slides or televisions, color papers, color positive films and color reversal papers. The present invention is especially preferably applicable to films for color dupe.

Suitable supports usable in the present invention are described, for example, on page 28 of the above-described RD. No. 17643, from right column, page 647 to left column, page 648 of RD. No. 18716 and on page 879 of RD. No. 307105.

The photosensitive material of the present invention has a total thickness of the hydrophilic colloidal layers on the emulsion layer-side of 28 μm or below, preferably 23 μm or below, more preferably 18 μm or below and particularly 16 μm or below. The film-swelling rate $T_{1/2}$ is preferably 30 sec or below, more preferably 20 sec or below. The thickness is determined at 25° C. and at a relative humidity of 55% (2 days). The film-swelling rate $T_{1/2}$ can be determined by a method known in this technical field. For example, it can be determined with a swellometer described on pages 124 to 129 of A. Green et al., "Photogr. Sci. Eng.", Vol. 19, No. 2. $T_{1/2}$ is defined to be the time required for attaining the thickness of a half (½) of the saturated film thickness (the saturated film thickness being 90% of the maximum thickness of the film swollen with the color developer at 30° C. for 3 minute 15 seconds).

The film-swelling rate $T_{1/2}$ can be controlled by adding a hardener to gelatin used as the binder or by varying the time conditions after the coating.

The photosensitive material used in the present invention preferably has a hydrophilic colloid layer (in other words, back layer) having total thickness of 2 to 20 μm on dry basis on the opposite side to the emulsion layer. The back layer preferably contains the above-described light absorber, filter dye, ultraviolet absorber, antistatic agent, hardener, binder, plasticizer, lubricant, coating aid, surfactant, etc. The swelling rate of the back layer is preferably 150 to 500%.

The color photosensitive material according to the present invention may be developed by a conventional method described in aforementioned RD. No. 17643, pages 28 to 29, ditto No. 18716, page 651, left to right columns, and ditto No. 30705, pages 880 to 881.

The color developer to be used in the development of the photosensitive material of the present invention is preferably an alkaline aqueous solution containing as a main component an aromatic primary amine color developing agent. As such a color developing agent there can be effectively used an aminophenolic compound. In particular, p-phenylenediamine compounds are preferably used. Typical examples of such p-phenylenediamine compounds include 3-methyl-4-amino-N,N-diethylaniline, 3-methyl-4-amino-N-ethyl-N-β-hydroxy-ethylaniline, 3-methyl-4-amino-N-ethyl-N-β-methanesulfonamidoethylaniline, 3-methyl-4-amino-N-ethyl-N-β-methoxyethylaniline, and sulfates, hydrochlorides and p-toluenesulfonates thereof. Particularly preferred among these compounds are 3-methyl-4-amino-N-ethyl-N-β-hydroxyethylaniline sulfate. These compounds can be used in combination of two or more thereof depending on the purpose of application.

The color developer normally contains a pH buffer such as carbonate, borate and phosphate of an alkali metal or a development inhibitor or fog inhibitor such as chlorides, bromides, iodides, benzimidazoles, benzothiazoles and mercapto compounds. If desired, the color developer may further contain various preservatives such as hydroxylamine, diethylhydroxylamine, sulfites, hydrazines (e.g., N,N-biscarboxymethylhydrazine), phenylsemicarbazides, triethanolamine and catecholsulfonic acids, organic solvents such as ethylene glycol and diethylene glycol, development accelerators such as benzyl alcohol, polyethylene glycol, quaternary ammonium salts, and amines, color-forming couplers, competing couplers, auxiliary developing agents such as 1-phenyl-3-pyrazolidone, viscosity-imparting agents, various chelating agents exemplified by aminopolycarboxylic acids, aminopolyphosphonic acids, alkylphosphonic acids, and phosphonocarboxylic acids (e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, and ethylenediamine-di(o-hydroxyphenylacetic acid), and salts thereof).

Further, when reversal processing is to be performed on the photographic material, color development is usually performed after black-and-white development. As the black-and-white developer, known black-and-white developers can be used singly or in combination, which include dihydroxybenzenes, such as hydroquinone, 3-pyrazolidones, such as 1-phenyl-3-pyrazolidone, or aminophenols, such as N-methyl-p-aminophenol. Theses black-and-white developers usually have a pH of from 9 to 12. The replenishment rate of the developer is usually 3 liter (hereinafter liter is also referred to as "L") or less per $m^2$ of the photosensitive material, though depending on the type of the color photographic material to be processed. The replenishment rate may be reduced to 500 milliliter/$m^2$ or less by decreasing the bromide ion concentration in the replenisher (hereinafter milliliter is also referred to as "mL"). If the replenishment rate is reduced, the area of the processing tank in contact with air is preferably reduced to inhibit the evaporation and air oxidation of the processing solution.

The area of the photographic processing solution in contact with air in the processing tank can be represented by an opening rate as defined by the following equation:

$$\text{Opening rate}=[\text{area of processing solution in contact with air } (cm^2)]/[\text{volume of processing solution } (cm^3)]$$

The opening rate as defined above is preferably in the range of 0.1 or less, more preferably 0.001 to 0.05. Examples of methods for reducing the opening rate include a method which comprises putting a cover such as floating lid on the surface of the processing solution in the processing tank, a method as disclosed in JP-A-1-82033 utilizing a mobile lid, and a slit development method as disclosed in JP-A-63-216050. The reduction of the opening rate is preferably effected in both color development and black-and-white development steps as well as all the subsequent steps such as bleach, blix, fixing, washing and stabilization. The replenishment rate can also be reduced by a means for suppressing accumulation of the bromide ion in the developing solution.

The period for the color development processing usually sets between 2 to 5 min, the processing time can be shortened further by setting high pH and temperature, and using high concentration color developer.

The photographic emulsion layer which has been color-developed is normally subjected to bleach. Bleach may be effected simultaneously with fixation (i.e., blix), or these two steps may be carried out separately. For speeding up of processing, bleach may be followed by blix. Further, any of an embodiment wherein two blix baths connected in series are used, an embodiment wherein blix is preceded by fixation, and an embodiment wherein blix is followed by bleach may be selected arbitrarily according to the purpose. Bleaching agents to be used include compounds of potyvalent metals, e.g., iron (III), peroxides, quinones, and nitro compounds. Typical examples of these bleaching agents are organic complex salts of iron (III) with, e.g., aminopolycarboxylic acids such as ethylenediaminetetraacetic acid, diethylenetriaminepentaacetic acid, cyclohexanediaminetetraacetic acid, methyliminodiacetic acrid, 1,3-diaminopropanetetraacetic acid and glycol ether diaminetetraacetic acid, or citric acid, tartaric acid, malic acid, etc. Of these, aminopolycarboxylic acid-iron (III) complex salts such as ethylenediaminetetraacetato iron (III) complex salts and 1,3-diaminopropanetetraacetato iron (III) complex salts are preferred in view of speeding up of processing and conservation of the environment. In particular, aminopolycarboxylic acid-iron (III) complex salts are useful in both of a bleaching solution and a blix solution. The pH value of a bleaching solution or blix solution comprising such an antinopolycarboxylic acid-iron (III) complex salts is normally in the range of 4.0 to 8. For speeding up of processing, the processing can be effected at an even lower pH value.

The bleaching bath, blix bath or a prebath thereof can contain, if desired, a bleaching accelerator. Examples of useful bleaching accelerators include compounds containing a mercapto group or a disulfide group as described in U.S. Pat. No. 3,893,858, West German Patents 1,290,812 and 2,059,988, JP-A's-53-32736, 53-57831, 53-37418, 53-72623, 53-95630, 53-95631, 53-104232, 53-124424, 53-141623, and 53-28426 and Research Disclosure No. 17129 (July 1978), thiazolidine derivatives as described in JP-A-51-140129, thiourea derivatives as described in JP-B-45-8506, JP-A's-52-20832, and 53-32735 and U.S. Pat. No. 3,706,561, iodides as described in West German Patent 1,127,715 and JP-A-58-16235, polyoxyethylene compounds as described in West German Patents 966,410 and 2,748,430, polyamine compounds as described in JP-B-45-8836, compounds as described in JP-A's-49-40943, 49-59644, 53-94927, 54-35727, 55-26506 and 58-163940, and bromine ions. Preferred among these compounds are compounds containing a mercapto group or disulfide group because of their great acceleratory effects. In particular, the compounds disclosed in U.S. Pat. No. 3,893,858, West German Patent 1,290,812 and JP-A-53-95630 are preferred. The compounds disclosed in U.S. Pat. No. 4,552,834 are also preferred. These bleaching accelerators may be incorporated into the photosensitive material. These bleaching accelerators are particularly effective for blix of color photosensitive materials for picture taking.

The bleaching solution or blix solution preferably contains an organic acid besides the above mentioned compounds for the purpose of inhibiting bleach stain. A particularly preferred organic acid is a compound with an acid dissociation constant (pKa) of 2 to 5. In particular, acetic acid, propionic acid, hydroxyacetic acid, etc. are preferred.

Examples of fixing agents to be contained in the fixing solution or blix solution include thiosulfates, thiocyanates, thioethers, thioureas, and a large amount of iodides. The thiosulfites are normally used. In particular, ammonium thiosulfate can be most widely used. Further, thiosulfates are preferably used in combination with thiocyanates, thioether compounds, thioureas, etc. As preservatives of the fixing or blix bath there can be preferably used sulfites, bisulfites, carbonyl bisulfite adducts or sulfinic acid compounds as described in European Patent 294769A. The fixing solution or blix solution preferably contains aminopolycarboxylic acids or organic phosphonic acids for the purpose of stabilizing the solution.

In the present invention, compounds having pKa of 6.0 to 9.0 are preferably added to the fixing solution or a bleach-fixing solution in order to pH adjustment. Preferablly, imidazoles such as imidazole, 1-methylimidazole, 1-ethylimidazole, and 2-methylimidazole are added in an amount of 0.1 to 10 mol/L.

The total time required for desilvering step is preferably as short as possible so long as no maldesilvering occurs. The desilvering time is preferably in the range of 1 to 3 minutes, more preferably 1 to 2 minutes. The processing temperature is in the range of 25° C. to 50° C., preferably 35° C. to 45° C. In the preferred temperature range, the desilvering rate can be improved and stain after processing can be effectively inhibited.

In the desilvering step, the agitation is preferably intensified as much as possible. Specific examples of such an agitation intensifying method include a method as described in JP-A-62-183460 which comprises jetting the processing solution to the surface of the emulsion layer in the photosensitive material, a method as described in JP-A-62-183461 which comprises improving the agitating effect by a rotary means, a method which comprises improving the agitating effect by moving the photosensitive material with the emulsion surface in contact with a wiper blade provided in the bath so that a turbulence occurs on the emulsion surface, and a method which comprises increasing the total circulated amount of processing solution. Such an agitation improving method can be effectively applied to the bleaching bath, blix bath or fixing bath. The improvement in agitation effect can be considered to expedite the supply of a bleaching agent, fixing agent or the like into emulsion film, resulting in an improvement in desilvering rate. The above mentioned agitation improving means can work more effectively when a bleach accelerator is used, remarkably increasing the bleach acceleration effect and eliminating the inhibition of fixing by the bleach accelerator.

The automatic developing machine to be used in the processing of the photosensitive material of the present invention is preferably equipped with a photosensitive material conveying means as disclosed in JP-A's-60-191257, 60-191258 and 60-191259. As described in above JP-A-60-191257, such a conveying means can remarkably reduce the amount of the processing solution carried from a bath to its subsequent bath, providing a high effect of inhibiting deterioration of the properties of the processing solution. This effect is remarkably effective for the reduction of the processing time or the amount of replenisher required at each step.

It is usual that the thus desilvered silver halide color photosensitive material of the present invention is subjected to washing and/or stabilization. The quantity of water to be used in the washing can be selected from a broad range depending on the characteristics of the photosensitive material (for example, the kind of materials such as couplers, etc.), the end use of the photosensitive material, the temperature of washing water, the number of washing tanks (number of stages), the replenishment system (e.g., counter-current system or concurrent system), and other various factors. Of these factors, the relationship between the number of washing tanks and the quantity of water in a multi-stage counter-current system can be obtained according to the method described in "Journal of the Society of Motion Picture and Television Engineers", vol. 64, pp. 248-253 (May 1955).

According to the multi-stage counter-current system described in the above reference, although the requisite amount of water can be greatly reduced, bacteria would grow due to an increase of the retention time of water in the tank, and floating masses of bacteria stick to the photosensitive material. In the processing for the color photosensitive material of the present invention, in order to cope with this problem, the method of reducing calcium and magnesium ion concentrations described in JP-A-62-288838 can be used very effectively. Further, it is also effective to use isothiazolone compounds or thiabenzazoles as described in JP-A-57-8542, chlorine type bactericides, e.g., chlorinated sodium isocyanurate, benzotriazole, and bactericides described in Hiroshi Horiguchi, "Bokinbobaizai no kagaku", published by Sankyo Shuppan, (1986), Eisei Gijutsu Gakkai (ed.), "Biseibutsu no mekkin, sakkin, bobigijutsu", Kogyogijutsukai, (1982), and Nippon Bokin Bobi Gakkai (ed.), "Bokin bobizai jiten" (1986).

The washing water has a pH value of from 4 to 9, preferably from 5 to 8 in the processing for the photosensitive material of the present invention. The temperature of the water and the washing time can be selected from broad ranges depending on the characteristics and end use of the photosensitive material, but usually ranges from 15° C. to 45° C. in temperature and from 20 seconds to 10 minutes in time, preferably from 25° C. to 45° C. in temperature and from 30 seconds to 5 minutes in time. The photosensitive material of the present invention may be directly processed with a stabilizer in place of the washing step. For the stabilization, any of the known techniques as described in JP-A's-57-8543, 58-14834 and 60-220345 can be used.

The aforesaid washing step may be followed by stabilization in some cases. For example, a stabilizing bath containing a dye stabilizer and a surface active agent as is used as a final bath for color photosensitive materials for picture taking can be used. Examples of such a dye stabilizer include aldehydes such as formalin and glutaraldehyde, N-methylol compounds, hexamethylenetetramine and aldehyde-bisulfite adducts. This stabilizing bath may also contain various chelating agents or antifungal agents.

The overflow accompanying replenishment of the washing bath and/or stabilizing bath can be reused in other steps such as desilvering. For example, in a processing using an automatic developing machine, if the above mentioned various processing solutions are subject to concentration due to evaporation, the concentration is preferably corrected for by the addition of water.

The silver halide color photosensitive material of the present invention may incorporate a color developing agent for the purpose of simplifying and expediting processing. Such a color developing agent is preferably used in the form of various precursors, when it is contained in the photosensitive material. Examples of such precursors include indoaniline compounds as described in U.S. Pat. Nos. 3,342,597, Schiff's base type compounds as described in U.S. Pat. No. 3,342,599, and Research Disclosure Nos. 14,850 and 15,159, and aldol compounds as described in Research Disclosure No. 13,924, metal complexes as described in U.S. Pat. No. 3,719,492, and urethane compounds as described in JP-A-53-135628.

The silver halide color photosensitive material of the present invention may optionally incorporate various 1-phenyl-3-pyrazolidones for the purpose of accelerating color development. Typical examples of such compounds are described in JP-A's-56-64339, 57-144547 and 58-115438.

In the present invention, the various processing solutions are used at a temperature of 10° C. to 5° C. The standard temperature range is normally from 33° C. to 38° C. However, a higher temperature range can be used to accelerate processing, reducing the processing time. On the contrary, a lower temperature range can be used to improve the picture quality or the stability of the processing solutions.

Further, the silver halide photosensitive material of the invention may be applied to heat-development photosensitive material as described, for example, in U.S. Pat. No. 4,500,626, and JP-A's-60-133449, 59-218443 and 61-238056, and EP 210 660A2.

Further, the silver halide color photosensitive material of the invention can exhibit advantages easily when it is applied to lens-fitted film unit described, for example, in Jap. Utility Model KOKOKU Publication Nos. 2-32615 and 3-39784, which is effective.

EXAMPLE

Examples of the present invention will be described below, which however in no way limit the scope of the present invention.

Example 1

Preparation of Emulsions

Seed Emulsion

Reference was made to the method of preparing silver halide tabular grains described in Example 2 of JP-A-10-293372. One liter of a dispersion medium solution containing 0.38 g of KBr and 0.5 g of low-molecular-weight gelatin (weight average molecular weight: about 15,000) was held at 40° C. in a reaction vessel. A 0.29 mol/liter aqueous $AgNO_3$ solution and a 0.29 mol/liter aqueous KBr solution each in an amount of 20 mL were simultaneously added thereto under agitation over a period of 40 sec. After the addition, 22 mL of a 10% KBr solution was added, and heated to 75° C. After the temperature rise, an aqueous gelatin solution consisting of 35 g of gelatin trimellitate and 250 mL of water (60° C.) was added to the dispersion medium solution. At that time, the pH value thereof was adjusted to 6.0. Thereafter, a 1.2 mol/liter aqueous $AgNO_3$ solution and a 1.2 mol/liter aqueous KBr solution were simultaneously added thereto. At that time, silver iodide fine grains were simultaneously added in such an amount that the amount of silver iodide based on added $AgNO_3$ was 3 mol %. At that time, the pBr value of the dispersion medium was maintained at 2.64. The thus obtained emulsion was desalted by the ultrafiltration method described in the descriptive portion and Example 2 of JP-A-2002-122952, and gelatin was added so as to accomplish regulations to a pH value of 5.7, a pAg value of 8.8 and, per kg of emulsion, a weight in terms of silver of 131.8 g and a gelatin weight of 64.1 g. Thus, a seed emulsion was obtained. In the resultant emulsion, 98% or more of the total projected area was occupied by tabular grains, and the average equivalent sphere diameter and average aspect ratio were 0.7 μm and 31, respectively.

Emulsion 1-A

Formation of Host Tabular Grains 1211 mL of an aqueous solution containing 46 g of gelatin trimellitate whose ratio of conversion to trimellitate was 97% and 1.7 g of KBr was vigorously agitated while maintaining the temperature thereof at 75° C. 185 g of the above seed emulsion was added, and further 0.3 g of modified silicon oil (L7602, produced by Nippon Unicar Company, Limited) was added. $H_2SO_4$ was added to thereby adjust the pH value to 5.5. 67.6 mL of an aqueous solution containing 7.0 g of $AgNO_3$ and a mixed aqueous solution of KBr and KI containing 3 mol % of KI were added by the double jet method over a period of 6 min while increasing the flow rate so that the final flow rate was 5.1 times the initial flow rate. During this period, the silver potential was maintained at +0 mV against saturated calomel electrode. 2 mg of sodium benzenethiosulfonate was added, and, while 762 mL of an aqueous solution containing 170 g of $AgNO_3$ and 762 mL of an aqueous solution containing 115.4 g of KBr, 5.0 g of KI and 76.2 g of gelatin of about 15000 weight average molecular weight were simultaneously charged in an agitation unit installed outside the reaction vessel to thereby prepare silver iodobromide fine grains of 3 mol % silver iodide content (average grain size: 0.010 μm), the silver iodobromide fine grains were incorporated in the reaction vessel over a period of 120 min. During this period, the silver potential was maintained at −20 mV against saturated calomel electrode. Subsequently, an aqueous solution of KBr and 131 mL of an aqueous solution containing 58.5 g of $AgNO_3$ were added by the double jet method over a period of 30 min. During this period, the silver potential against saturated calomel electrode was maintained at +20 mV for the first period of 20 min and +100 mV for the rest of 10 min.

Formation of Epitaxial Junction

After the above formation of host tabular grains, the emulsion was cooled to 50° C., and 156 mL of a 0.5% aqueous KI solution was added. The mixture was agitated for 20 min while maintaining the temperature at 50° C., and an aqueous solution of $K_4[RuCN_6]$ was added in an amount of $1.0\times10^{-5}$ mol/molAg based on the total silver quantity of emulsion. Thereafter, 140 mL of an aqueous solution containing 1.9 g of NaCl was added, and 80 mL of an aqueous solution containing 3.1 g of $AgNO_3$ was added. Still thereafter, 50 mL of an aqueous solution containing 2.04 g of $AgNO_3$ and 50 mL of an aqueous solution containing 0.84 g of gelatin, 1.43 g of KBr and 0.20 g of KI were simultaneously charged in a mixer separate from the reaction vessel to thereby prepare silver iodobromide fine grains (average grain size: 0.03 μm), and the silver iodobromide fine grains were incorporated in the reaction vessel. The thus obtained emulsion was desalted by the ultrafiltration method described in the descriptive portion and Example 2 of JP-A-2002-122952, and gelatin was added so as to adjust the pH and pAg at 40° C. to 5.8 and 8.7, respectively. Compounds 1 and 2 were added, and the emulsion was heated to 50° C. Sensitizing dyes 1, 2 and 3 were added, and thereafter potassium thiocyanate, chloroauric acid, sodium thiosulfate and N,N-dimethylselenourea were added, thereby accomplishing the optimum chemical sensitization thereof. Upon the completion of chemical sensitization, compounds 3 and 4 were added. The expression "optimum chemical sensitization" used herein means that the addition amount of sensitizing dyes and compounds was selected from the range of $10^{-1}$ to $10^{-8}$ mol per mol of silver halides.

Compound 1

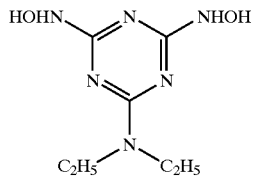

Compound 2

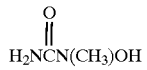

Spectral sensitizing dye 1 for green-sensitive emulsion

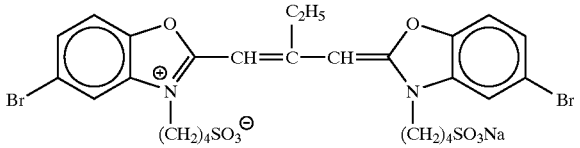

Spectral sensitizing dye 2 for green-sensitive emulsion

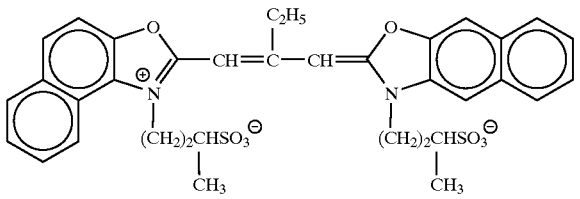

-continued

Spectral sensitizing dye 3 for green-sensitive emulsion

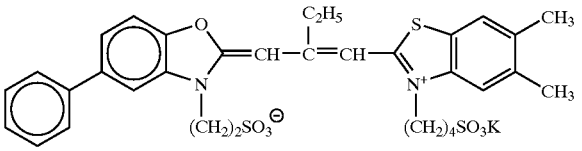

Dye 1:Dye 2:Dye 3 = 76:17:7 (molar ratio)

Compound 3

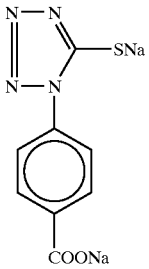

Compound 4

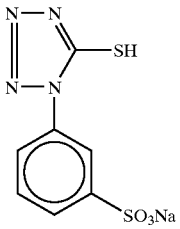

With respect to the thus obtained emulsion, 98% or more (grain numerical ratio) of all the grains consisted of silver iodochlorobromide emulsion having portions of host tabular grains of silver iodobromide whose parallel main planes were (111) faces. With respect to the obtained emulsion, the average equivalent sphere diameter was 1.3 μm; the variation coefficient of equivalent sphere diameter distribution 11%; the average equivalent circle diameter 3.35 μm; the variation coefficient of equivalent circle diameter distribution 20%; the average grain thickness 0.130 μm; and the average aspect ratio 26. Similar results were obtained with respect to the following emulsions 1-B to 1-G.

Emulsion 1-B

Formation of Host Tabular Grains

The host tabular grains were prepared in the same manner as in the preparation of emulsion 1-A.

Formation of Epitaxial Junction

After the above formation of host tabular grains, the emulsion was cooled to 50° C., and 156 mL of a 0.5% aqueous KI solution was added. The mixture was agitated for 20 min while maintaining the temperature at 50° C., and an aqueous solution of $K_4[RuCN_6]$ was added in an amount of $1.0\times10^{-5}$ mol/molAg based on the total silver quantity of emulsion. Thereafter, 140 mL of an aqueous solution containing 4.8 g of NaCl was added, and 80 mL of an aqueous solution containing 7.8 g of $AgNO_3$ was added. Still thereafter, 50 mL of an aqueous solution containing 2.04 g of $AgNO_3$ and 50 mL of an aqueous solution containing 0.84 g of gelatin, 1.43 g of KBr and 0.20 g of KI were simultaneously charged in a mixer separate from the reaction vessel to thereby prepare silver iodobromide fine grains (average grain size: 0.03 μm), and the silver iodobromide fine grains were incorporated in the reaction vessel. The thus obtained emulsion was desalted by the ultrafiltration method described in the descriptive portion and Example 2 of-JP-A-2002-122952, and gelatin was added so as to adjust the pH and pAg at 40° C. to 5.8 and 8.7, respectively. The above compounds 1 and 2 were added, and thereafter the emulsion was heated to 50° C. The above sensitizing dyes 1, 2 and 3 were added, and thereafter potassium thiocyanate, chloroauric acid, sodium thiosulfate and N,N-dimethylselenourea were added, thereby accomplishing the optimum chemical sensitization thereof. Upon the completion of chemical sensitization, the above compounds 3 and 4 were added. The expression "optimum chemical sensitization" used herein means that the addition amount of sensitizing dyes and compounds was selected from the range of $10^{-1}$ to $10^{-8}$ mol per mol of silver halides.

Emulsion 1-C

Formation of Host Tabular Grains

The host tabular grains were prepared in the same manner as in the preparation of emulsion 1-A.

Formation of Epitaxial Junction

After the above formation of host tabular grains, the emulsion was cooled to 50° C., and 156 mL of a 0.5% aqueous KI solution was added. The mixture was agitated for 20 min while maintaining the temperature at 50° C., and an aqueous solution of $K_4[RuCN_6]$ was added in an amount of $1.0\times10^{-5}$ mol/molAg based on the total silver quantity of emulsion. Thereafter, 140 mL of an aqueous solution containing 4.8 g of NaCl was added, and 80 mL of an aqueous solution containing 7.8 g of $AgNO_3$ was added. Still thereafter, 125 mL of an aqueous solution containing 5.10 g of $AgNO_3$ and 125 mL of an aqueous solution containing 2.10 g of gelatin, 3.58 g of KBr and 0.5 g of KI were simultaneously charged in a mixer separate from the reaction vessel to thereby prepare silver iodobromide fine grains (average grain size: 0.03 μm), and the silver iodobromide fine grains were incorporated in the reaction vessel. The thus obtained emulsion was desalted by the ultrafiltration method described in the descriptive portion and Example 2 of JP-A-2002-122952, and gelatin was added so as to adjust the pH and pAg at 40° C. to 5.8 and 8.7, respectively. The above compounds 1 and 2 were added, and the emulsion was heated to 50° C. The above sensitizing dyes 1, 2 and 3 were added, and thereafter potassium thiocyanate, chloroauric acid, sodium thiosulfate and N,N-dimethylselenourea were added, thereby accomplishing the optimum chemical sensitization thereof. Upon the completion of chemical sensitization, the above compounds 3 and 4 were added. The expression "optimum chemical sensitization" used herein means that the addition amount of sensitizing dyes and compounds was selected from the range of $10^{-1}$ to $10^{-8}$ mol per mol of silver halides.

Emulsion 1-D

Formation of Host Tabular Grains

The host tabular grains were prepared in the same manner as in the preparation of emulsion 1-A.

Formation of Epitaxial Junction

After the above formation of host tabular grains, the emulsion was cooled to 50° C., and 156 mL of a 0.5% aqueous KI solution was added. The mixture was agitated for 20 min while maintaining the temperature at 50° C., and an aqueous solution of $K_4[RuCN_6]$ was added in an amount of $1.0\times10^{-5}$ mol/molAg based on the total silver quantity of emulsion. Thereafter, 140 mL of an aqueous solution containing 9.5 g of NaCl was added, and 80 mL of an aqueous solution containing 15.5 g of $AgNO_3$ was added. Still thereafter, 125 mL of an aqueous solution containing 5.10 g of $AgNO_3$ and 125 mL of an aqueous solution containing 2.10 g of gelatin, 3.58 g of KBr and 0.50 g of KI were simultaneously charged in a mixer separate from the reaction vessel to thereby prepare silver iodobromide fine grains (average grain size: 0.03 μm), and the silver iodobromide fine grains were incorporated in the reaction vessel. The thus obtained emulsion was desalted by the ultrafiltration method described in the descriptive portion and Example 2 of JP-A-2002-122952, and gelatin was added so as to adjust the pH and pAg at 40° C. to 5.8 and 8.7, respectively. The above compounds 1 and 2 were added, and the emulsion was heated to 50° C. The above sensitizing dyes 1, 2 and 3 were added, and thereafter potassium thiocyanate, chloroauric acid, sodium thiosulfate and N,N-dimethylselenourea were added, thereby accomplishing the optimum chemical sensitization thereof. Upon the completion of chemical sensitization, the above compounds 3 and 4 were added. The expression "optimum chemical sensitization" used herein means that the addition amount of sensitizing dyes and compounds was selected from the range of $10^{-1}$ to $10^{-8}$ mol per mol of silver halides.

Emulsion 1-E

Formation of Host Tabular Grains

The host tabular grains were prepared in the same manner as in the preparation of emulsion 1-A.

Formation of Epitaxial Junction

After the above formation of host tabular grains, the emulsion was cooled to 50° C., and 156 mL of a 0.5% aqueous KI solution was added. The mixture was agitated for 20 min while maintaining the temperature at 50° C., and an aqueous solution of $K_4[RuCN_6]$ was added in an amount of $1.0\times10^{-5}$ mol/molAg based on the total silver quantity of emulsion. Thereafter, 140 mL of an aqueous solution containing 9.5 g of NaCl was added, and 80 mL of an aqueous solution containing 15.5 g of $AgNO_3$ was added. Still thereafter, 250 mL of an aqueous solution containing 10.2 g of $AgNO_3$ and 250 mL of an aqueous solution containing 4.2 g of gelatin, 7.2 g of KBr and 1.0 g of KI were simultaneously charged in a mixer separate from the reaction vessel to thereby prepare silver iodobromide fine grains (average grain size: 0.03 μm), and the silver iodobromide fine grains were incorporated in the reaction vessel. The thus obtained emulsion was desalted by the ultrafiltration method described in the descriptive portion and Example 2 of JP-A-2002-122952, and gelatin was added so as to adjust the pH and pAg at 40° C. to 5.8 and 8.7, respectively. The above compounds 1 and 2 were added, and the emulsion was heated to 50° C. The above sensitizing dyes 1, 2 and 3 were added, and thereafter potassium thiocyanate, chloroauric acid, sodium thiosulfate and N,N-dimethylselenourea were added, thereby accomplishing the optimum chemical sensitization thereof. Upon the completion of chemical sensitization, the above compounds 3 and 4 were added. The expression "optimum chemical sensitization" used herein means that the addition amount of sensitizing dyes and compounds was selected from the range of $10^{-1}$ to $10^{-8}$ mol per mol of silver halides.

Emulsion 1-F

Formation of Host Tabular Grains

The host tabular grains were prepared in the same manner as in the preparation of emulsion 1-A.

Formation of Epitaxial Junction

After the above formation of host tabular grains, the emulsion was cooled to 50° C., and 156 mL of a 0.5% aqueous KI solution was added. The mixture was agitated for 20 min while maintaining the temperature at 50° C., and an aqueous solution of $K_4[RuCN_6]$ was added in an amount of $1.0\times10^{-5}$ mol/molAg based on the total silver quantity of emulsion. Thereafter, 140 mL of an aqueous solution containing 9.5 g of NaCl was added, and 80 mL of an aqueous solution containing 15.5 g of $AgNO_3$ was added. Still thereafter, 500 mL of an aqueous solution containing 20.4 g of $AgNO_3$ and 500 mL of an aqueous solution containing 8.4 g of gelatin, 14.3 g of KBr and 2.0 g of KI were simultaneously charged in a mixer separate from the reaction vessel to thereby prepare silver iodobromide fine grains (average grain size: 0.03 μm), and the silver iodobromide fine grains were incorporated in the reaction vessel. The thus obtained emulsion was desalted by the ultrafiltration method described in the descriptive portion and Example 2 of JP-A-2002-122952, and gelatin was added so as to adjust the pH and pAg at 40° C. to 5.8 and 8.7, respectively. The above compounds 1 and 2 were added, and the emulsion was heated to 50° C. The above sensitizing dyes 1, 2 and 3 were added, and thereafter potassium thiocyanate, chloroauric acid, sodium thiosulfate and N,N-dimethylselenourea were added, thereby accomplishing the optimum chemical sensitization thereof. Upon the completion of chemical sensitization, the above compounds 3 and 4 were added. The expression "optimum chemical sensitization" used herein means that the addition amount of sensitizing dyes and compounds was selected from the range of $10^{-1}$ to $10^{-8}$ mol per mol of silver halides.

Emulsion 1-G

Formation of Host Tabular Grains

The host tabular grains were prepared in the same manner as in the preparation of emulsion 1-A.

Formation of Epitaxial Junction

After the above formation of host tabular grains, the emulsion was cooled to 50° C., and 156 mL of a 0.5% aqueous KI solution was added. The mixture was agitated for 20 min while maintaining the temperature at 50° C., and an aqueous solution of $K_4[RuCN_6]$ was added in an amount of $1.0\times10^{-5}$ mol/molAg based on the total silver quantity of emulsion. Thereafter, 140 mL of an aqueous solution containing 11.4 g of NaCl was added, and 80 mL of an aqueous solution containing 18.6 g of $AgNO_3$ was added. Still thereafter, 300 mL of an aqueous solution containing 12.2 g of $AgNO_3$ and 300 mL of an aqueous solution containing 5.04 g of gelatin, 8.58 g of KBr and 1.20 g of KI were simultaneously charged in a mixer separate from the reaction vessel to thereby prepare silver iodobromide fine grains (average grain size: 0.03 μm), and the silver iodobromide fine grains were incorporated in the reaction vessel. The thus obtained emulsion was desalted by the ultrafiltration method described in the descriptive portion and Example 2 of JP-A-2002-122952, and gelatin was added so as to adjust the pH and pAg at 40° C. to 5.8 and 8.7, respectively. The above compounds 1 and 2 were added, and the emulsion was heated to 50° C. The above sensitizing dyes 1, 2 and 3 were added, and thereafter potassium thiocyanate, bis(1,4,5-trimethyl-1,2,4-triazolium-3-thiolatogold(I)) tetrafluoroborate, carboxymethyltrimethylthiourea and N,N-dimethylselenourea were added, thereby accomplishing the optimum chemical sensitization thereof. Upon the completion of chemical sensitization, the above compounds 3 and 4 were added. The expression "optimum chemical sensitization" used herein means that the addition amount of sensitizing dyes and compounds was selected from the range of $10^{-1}$ to $10^{-8}$ mol per mol of silver halides.

With respect to these emulsions 1-A to 1-G, the ratios (%, grain numerical ratio) of the following grains to all the grains contained in the silver halide photographic emulsion in relevant emulsion are summarized in Table 1: (i) grains each having, per grain, at least one silver halide epitaxial portion formed only on corner portions of host tabular grains; (ii) grains each having, per grain, 3 to 6 epitaxial portions formed only on respective corner portions of host tabular grains; (iii) grains each having the at least one epitaxial portion and the at least one epitaxial portion has a face parallel to the main planes of the host tabular grains; (iv) grains each having the at least one epitaxial portion and the at least one epitaxial portion has a {100} face; (v) grains each having the at least one epitaxial portion and the at least one epitaxial portion has at least one dislocation line; and (vi) grains each having the at least one epitaxial portion and the at least one epitaxial portion has therein an inner region (A) of less than 30 mol % silver bromide content and an outer region (B) of 30 mol % or more silver bromide content. (With respect to all the emulsions, determination was made by observation through a transmission electron microscope or an analytical electron microscope according to the method described in the descriptive portion.)

TABLE 1

| Emulsion | (i) | (ii) | (iii) | (iv) | (v) | (vi) |
|---|---|---|---|---|---|---|
| 1-A | 40 | 10 | 30 | 38 | 27 | 31 |
| 1-B | 60 | 24 | 35 | 60 | 33 | 40 |
| 1-C | 60 | 24 | 52 | 60 | 51 | 56 |
| 1-D | 98 | 64 | 56 | 97 | 54 | 53 |
| 1-E | 98 | 64 | 95 | 96 | 92 | 90 |
| 1-F | 98 | 65 | 40 | 98 | 37 | 39 |
| 1-G | 99 | 82 | 97 | 98 | 96 | 98 |

(i) Ratio in % (grain numerical ratio to the total grains) of grains each having, per grain, at least one silver halide epitaxial junction portion formed only on corner portions of host tabular grains;
(ii) Ratio in % (grain numerical ratio to the total grains) of grains each having, per grain, 3 to 6 epitaxial junction portions formed only on respective corner portions of host tabular grains;
(iii) Ratio in % (grain numerical ratio to the total grains) of grains each having the at least one epitaxial junction portion and a part of the at least one epitaxial junction portion has a face parallel to the main planes of the host tabular grains;
(iv) Ratio in % (grain numerical ratio to the total grains) of grains each having the at least one epitaxial junction portion and a part of the at least one epitaxial junction portion has a {100} face;
(v) Ratio in % (grain numerical ratio to the total grains) of grains each having the at least one epitaxial junction portion and the at least one epitaxial junction portion has at least one dislocation line; and
(vi) grains each having the at least one epitaxial junction portion and the at least one epitaxial junction portion has therein an inner region (A) of less than 30 mol % silver bromide content and an outer region of 30 mol % or more silver bromide content.

Preparation of Mono-layer, Coated Samples and Evaluation Thereof

A support of cellulose triacetate film furnished with a substratum was coated with each of the above emulsions 1-A to 1-G under the following coating conditions.

Coating Conditions

| | |
|---|---|
| Emulsion layer | |
| Emulsion of varied type Ag | 1.6 g/m$^2$ |
| Coupler compound A | $2.3 \times 10^{-3}$ mol/m$^2$ |
| Tricresyl phosphate | 1.3 g/m$^2$ |
| Gelatin | 3.2 g/m$^2$ |
| Protective layer | |
| 2,4-Dichloro-6-hydroxy-s-triazine sodium salt | 0.08 g/m$^2$ |
| Gelatin | 1.80 g/m$^2$ |
| Antifoggant, compound B | $8.4 \times 10^{-3}$ mol/m$^2$ |

Compound A

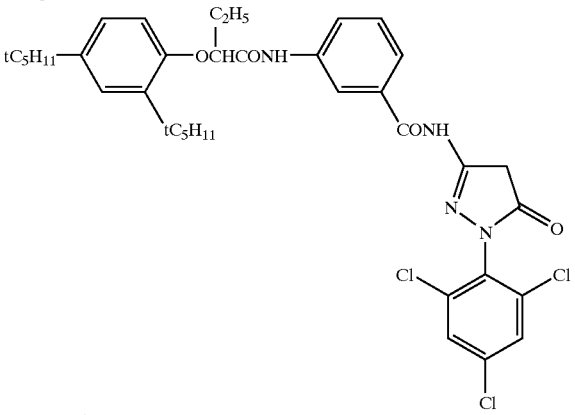

Compound B

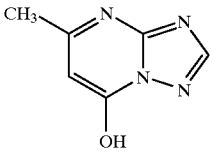

The thus obtained samples 101 to 107 were hardened for 14 hr under such conditions that the temperature and relative humidity were 40° C. and 70%, respectively. The hardened samples were exposed for 1/100 sec through gelatin filter SC-39 manufactured by Fuji Photo Film Co., Ltd. (long wave light transmission filter of 390 nm cut-off wavelength) and continuous wedge, and subjected to the later described development processing. The photographic speed and gradation of developed samples were evaluated by carrying out density measuring through a green filter.

The processing was carried out by means of Nega Processor FP-350 manufactured by Fuji Photo Film Co., Ltd. in the manner as described in Example 1 of JP-A-2001-228572.

Results of photographic speed and gradation are listed in the following Table 2. The photographic speed was expressed in terms of the relative value of inverse number of exposure intensity required to reach a density of fog density plus 0.2 on obtained characteristic curves (providing that the photographic speed of sample 101 was 100). With respect to the gradation, its value was defined as the slope of a straight line binding two points respectively indicating densities which were 0.3 and 1.0 higher than fog density on characteristic curves, and expressed as the relative value (the value of gradation of the sample 101 was regarded as 100).

TABLE 2

| Sample | Emulsion | *Speed | *Gradation | Remarks |
|---|---|---|---|---|
| 101 | 1-A | 100 | 100 | Comp. |
| 102 | 1-B | 107 | 104 | Comp. |
| 103 | 1-C | 135 | 120 | Inv. |

TABLE 2-continued

| Sample | Emulsion | *Speed | *Gradation | Remarks |
|---|---|---|---|---|
| 104 | 1-D | 151 | 128 | Inv. |
| 105 | 1-E | 162 | 130 | Inv. |
| 106 | 1-F | 105 | 109 | Comp. |
| 107 | 1-G | 174 | 132 | Inv. |

*Relative value assuming speed and gradation of Sample 101 as 100.

From comparison of samples 103, 104, 105 and 107 with samples 101, 102 and 106, it is apparent that the samples wherein the emulsions of the present invention are employed realize high photographic speed and enhanced gradation (hard gradation).

Example 2

Preparation of Multiplayer, Coated Samples and Evaluation Thereof

Multilayer, coated samples 201 to 207 for color negative of the same constitution as that of sample 405 of Example 4 of JP-A-2001-228572 except for the following change were prepared.

The emulsion E of the 11th layer (high-speed green-sensitive layer) of sample 405 described in JP-A-2001-228572 was replaced by the above emulsions 1-A to 1-G of the present invention, thereby obtaining samples 201 to 207.

The thus obtained samples 201 to 207 were hardened for 14 hr under such conditions that the temperature and relative humidity were 40° C. and 70%, respectively. The hardened samples were exposed for 1/100 sec through gelatin filter SC-39 manufactured by Fuji Photo Film Co., Ltd. (long wave light transmission filter of 390 nm cut-off wavelength) and continuous wedge, and subjected to the following development processing. The photographic speed and gradation of developed samples were evaluated by carrying out density measuring through a green filter.

The processing was carried out by means of Automatic Processor FP-360B manufactured by Fuji Photo Film Co., Ltd. in the manner as described in Example 4 of JP-A-2001-228572.

Results of photographic speed and gradation are listed in the following Table 3. The photographic speed was expressed in terms of the relative value of inverse number of exposure intensity required to reach a density of fog density plus 0.1 on obtained magenta density characteristic curves (providing that the photographic speed of sample 101 was 100). With respect to the gradation, its value was defined as the slope of a straight line binding two points respectively indicating densities which were 0.1 and 0.3 higher than fog density on characteristic curves, and expressed as the relative value (the value of gradation of the sample 101 was regarded as 100).

TABLE 3

| Sample | Emulsion | *Speed | *Gradation | Remarks |
|---|---|---|---|---|
| 201 | 1-A | 100 | 100 | Comp. |
| 202 | 1-B | 105 | 102 | Comp. |
| 203 | 1-C | 132 | 115 | Inv. |
| 204 | 1-D | 148 | 121 | Inv. |
| 205 | 1-E | 155 | 123 | Inv. |
| 206 | 1-F | 102 | 104 | Comp. |
| 207 | 1-G | 166 | 125 | Inv. |

*Relative value assuming speed and gradation of Sample 201 as 100.

From comparison of samples 203, 204, 205 and 207 with samples 201, 202 and 206, it is apparent that with respect to the samples wherein the emulsions of the present invention were employed, the effect of the present invention was also striking in the color negative multilayers as in the results of Example 1.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion wherein epitaxial junction type tabular grains each satisfying the following requirements (i) to (iv), occupy 100 to 50% (grain numerical ratio) of all the grains contained in the silver halide photographic emulsion:

(i) host tabular grain is a tabular grain of silver iodobromide or silver iodochlorobromide having {111} faces as main planes and two parallel twin planes;

(ii) at least one silver halide epitaxial portion is formed, per grain, only on a corner portion of the host tabular grain;

(iii) a portion of an external surface of the silver halide epitaxial portion has a face parallel to the main plane of the host tabular grain; and (iv) another portion of the external surface of the silver halide epitaxial portion has a {100} face.

2. The silver halide photographic emulsion according to claim 1, wherein the epitaxial junction type tabular grains each satisfying the requirements (i) to (iv) occupy 100 to 80% (grain numerical ratio) of all the grains contained in the silver halide photographic emulsion.

3. The silver halide photographic emulsion according to claim 1, wherein the epitaxial junction type tabular grains each satisfying requirements (i) to (iv) further satisfying the following requirement (v):

(v) three to six silver halide epitaxial portions are formed, per grain, only on corner portions of the host tabular grain.

4. The silver halide photographic emulsion according to claim 3, wherein the epitaxial junction type tabular grains each satisfying the requirements (i) to (v) occupy 100 to 80% (grain numerical ratio) of all the grains contained in the silver halide photographic emulsion.

5. The silver halide photographic emulsion according to claim 1, wherein at least one of the silver halide epitaxial portions, per grain, has at least one dislocation line.

6. The silver halide photographic emulsion according to claim 1, wherein at least one of the silver halide epitaxial portions has, per silver halide epitaxial portion, (A) an inner region of the epitaxial portion having a silver bromide content of less than 30 mol %, and (B) an outer region of the epitaxial portion having a silver bromide content of 30 mol % or more.

7. A silver halide photosensitive material comprising at least one silver halide emulsion layer on a support, wherein at least one of the silver halide emulsion layer contains the silver halide photographic emulsion according to claim 1.

* * * * *